US007155931B2

(12) United States Patent
Wilkinson et al.

(10) Patent No.: US 7,155,931 B2
(45) Date of Patent: Jan. 2, 2007

(54) LIQUEFIED NATURAL GAS PROCESSING

(75) Inventors: John D. Wilkinson, Midland, TX (US); Hank M. Hudson, Midland, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 461 days.

(21) Appl. No.: 10/675,785

(22) Filed: Sep. 30, 2003

(65) Prior Publication Data

US 2005/0066686 A1 Mar. 31, 2005

(51) Int. Cl.
*F25J 3/00* (2006.01)

(52) U.S. Cl. ..... 62/620; 62/625; 62/627; 62/630

(58) Field of Classification Search ..... 62/620, 62/618, 625, 627, 630
See application file for complete search history.

(56) References Cited

U.S. PATENT DOCUMENTS

| | | | | |
|---|---|---|---|---|
| 2,952,984 | A * | 9/1960 | Marshall, Jr. | 62/622 |
| 3,292,380 | A | 12/1966 | Bucklin | 62/20 |
| 3,524,897 | A * | 8/1970 | Kniel | 585/634 |
| 3,837,172 | A | 9/1974 | Markbreiter et al. | 62/621 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,445,917 | A | 5/1984 | Chiu | 62/625 |
| 4,519,824 | A | 5/1985 | Huebel | 62/621 |
| 4,525,185 | A | 6/1985 | Newton | 62/612 |
| 4,545,795 | A | 10/1985 | Liu et al. | 62/613 |
| 4,600,421 | A | 7/1986 | Kummann | 62/621 |
| 4,617,039 | A | 10/1986 | Buck | 62/621 |
| 4,687,499 | A | 8/1987 | Aghili | 62/621 |
| 4,689,063 | A | 8/1987 | Paradowski et al. | 62/627 |
| 4,690,702 | A | 9/1987 | Paradowski et al. | 62/621 |

(Continued)

FOREIGN PATENT DOCUMENTS

FR 1535846 A 8/1968

(Continued)

OTHER PUBLICATIONS

U.S. Appl. No. 09/677,220, filed Oct. 2000, Spec. & Figs.

(Continued)

*Primary Examiner*—William C. Doerrler
(74) *Attorney, Agent, or Firm*—Fitzpatrick, Cella, Harper & Scinto

(57) ABSTRACT

A process and apparatus for the recovery of ethane, ethylene, propane, propylene, and heavier hydrocarbons from a liquefied natural gas (LNG) stream is disclosed. The LNG feed stream is directed in heat exchanger relation with a warmer distillation stream rising from the fractionation stages of a distillation column, whereby the LNG feed stream is partially heated and the distillation stream is partially condensed. The partially condensed distillation stream is separated to provide volatile residue gas and a reflux stream, whereupon the reflux stream is supplied to the column at a top column feed position. A portion of the partially heated LNG feed stream is supplied to the column at an upper mid-column feed point, and the remaining portion is heated further to partially or totally vaporize it and thereafter supplied to the column at a lower mid-column feed position. The quantities and temperatures of the feeds to the column are effective to maintain the column overhead temperature at a temperature whereby the major portion of the desired components is recovered in the bottom liquid product from the column.

47 Claims, 20 Drawing Sheets

U.S. PATENT DOCUMENTS

| | | | | |
|---|---|---|---|---|
| 4,707,170 | A | 11/1987 | Ayres et al. | 62/627 |
| 4,710,214 | A | 12/1987 | Sharma et al. | 62/621 |
| 4,755,200 | A | 7/1988 | Liu et al. | 62/612 |
| 4,851,020 | A | 7/1989 | Montgomery, IV | 62/621 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 4,895,584 | A | 1/1990 | Buck et al. | 62/621 |
| RE33,408 | E | 10/1990 | Khan | 62/29 |
| 5,114,451 | A * | 5/1992 | Rambo et al. | 62/623 |
| 5,275,005 | A | 1/1994 | Campbell et al. | 62/621 |
| 5,291,736 | A | 3/1994 | Paradowski | 62/613 |
| 5,363,655 | A | 11/1994 | Kikkawa et al. | 62/613 |
| 5,365,740 | A | 11/1994 | Kikkawa et al. | 62/613 |
| 5,421,165 | A * | 6/1995 | Paradowski et al. | 62/621 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,600,969 | A | 2/1997 | Low | 62/622 |
| 5,615,561 | A | 4/1997 | Houshmand et al. | 62/611 |
| 5,651,269 | A | 7/1997 | Prevost et al. | 62/613 |
| 5,755,114 | A | 5/1998 | Foglietta | 62/618 |
| 5,755,115 | A | 5/1998 | Manley | 62/620 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,893,274 | A | 4/1999 | Nagelvoort et al. | 62/613 |
| 5,983,664 | A | 11/1999 | Campbell et al. | 62/621 |
| 6,014,869 | A * | 1/2000 | Elion et al. | 62/621 |
| 6,023,942 | A | 2/2000 | Thomas et al. | 62/613 |
| 6,053,007 | A | 4/2000 | Victory et al. | 62/619 |
| 6,062,041 | A | 5/2000 | Kikkawa et al. | 62/613 |
| 6,116,050 | A | 9/2000 | Yao et al. | 62/630 |
| 6,119,479 | A | 9/2000 | Roberts et al. | 62/612 |
| 6,125,653 | A | 10/2000 | Shu et al. | 62/622 |
| 6,182,469 | B1 | 2/2001 | Campbell et al. | 62/621 |
| 6,250,105 | B1 | 6/2001 | Kimble | 62/613 |
| 6,269,655 | B1 | 8/2001 | Roberts et al. | 62/612 |
| 6,272,882 | B1 | 8/2001 | Hodges et al. | 62/613 |
| 6,308,531 | B1 | 10/2001 | Roberts et al. | 62/611 |
| 6,324,867 | B1 | 12/2001 | Fanning et al. | 62/613 |
| 6,336,344 | B1 | 1/2002 | O'Brien | 62/627 |
| 6,347,532 | B1 | 2/2002 | Agrawal et al. | 62/612 |
| 6,363,744 | B1 | 4/2002 | Finn et al. | 62/621 |
| 6,367,286 | B1 | 4/2002 | Price | 62/613 |
| 6,526,777 | B1 | 3/2003 | Campbell et al. | 62/621 |
| 6,564,579 | B1 * | 5/2003 | McCartney | 62/620 |
| 6,604,380 | B1 * | 8/2003 | Reddick et al. | 62/620 |
| 6,742,358 | B1 | 6/2004 | Wilkinson et al. | 62/613 |
| 6,907,752 | B1 * | 6/2005 | Schroeder et al. | 62/620 |
| 6,941,771 | B1 * | 9/2005 | Reddick et al. | 62/620 |
| 2003/0158458 | A1 * | 8/2003 | Prim | 585/800 |
| 2004/0079107 | A1 | 4/2004 | Wilkinson et al. | 62/611 |
| 2005/0061029 | A1 | 3/2005 | Narinsky | 62/620 |
| 2005/0155381 | A1 | 7/2005 | Yang et al. | 62/620 |

FOREIGN PATENT DOCUMENTS

| | | | |
|---|---|---|---|
| WO | 2004/109180 | A | 12/2004 |
| WO | 2005/015100 | A | 2/2005 |
| WO | 2005/035692 | A | 4/2005 |

OTHER PUBLICATIONS

Finn, Adrian J., Grant L. Johnson, and Terry R. Tomilson, "LNG Technology for Offshore and Mid-Scale Plants", Proceedings of the Seventy-Ninth Annual Convention of the Gas Processors Association, pp. 429-450, Atlanta, Georgia, Mar. 13-15, 2000.

Kikkawa, Yoshitsugi, Masaaki Ohishi, and Noriyoshi Nozawa, "Optimize the Power System of Baseload LNG Plant", Proceedings of the Eightieth Annual Convention of the Gas Processors Association, San Antonio, Texas, Mar. 12-14, 2001.

Price, Brian C., "LNG Production for Peak Shaving Operations", Proceedings of the Seventy-Eighth Annual Convention of the Gas Processors Association, pp. 273-280, Nashville, Tennessee, Mar. 1-3, 1999.

Huang et al., "Select the Optimum Extraction Method for LNG Regasification; Varying Energy Compositions of LNG Imports may Require Terminal Operators to Remove $C_2$+ Compounds before Injecting Regasified LNG into Pipelines", *Hydrocarbon Processing*, 83, 57-62, Jul. 2004.

Yang et al., "Cost-Effective Design Reduces $C_2$ and $C_3$ at LNG Receiving Terminals", *Oil & Gas Journal*, 50-53, May 26, 2003.

* cited by examiner

LIQUEFIED NATURAL GAS PROCESSING

BACKGROUND OF THE INVENTION

This invention relates to a process for the separation of ethane and heavier hydrocarbons or propane and heavier hydrocarbons from liquefied natural gas, hereinafter referred to as LNG, to provide a volatile methane-rich residue gas stream and a less volatile natural gas liquids (NGL) or liquefied petroleum gas (LPG) stream.

As an alternative to transportation in pipelines, natural gas at remote locations is sometimes liquefied and transported in special LNG tankers to appropriate LNG receiving and storage terminals. The LNG can then be re-vaporized and used as a gaseous fuel in the same fashion as natural gas. Although LNG usually has a major proportion of methane, i.e., methane comprises at least 50 mole percent of the LNG, it also contains relatively lesser amounts of heavier hydrocarbons such as ethane, propane, butanes, and the like, as well as nitrogen. It is often necessary to separate some or all of the heavier hydrocarbons from the methane in the LNG so that the gaseous fuel resulting from vaporizing the LNG conforms to pipeline specifications for heating value. In addition, it is often also desirable to separate the heavier hydrocarbons from the methane because these hydrocarbons have a higher value as liquid products (for use as petrochemical feedstocks, as an example) than their value as fuel.

Although there are many processes which may be used to separate ethane and heavier hydrocarbons from LNG, these processes often must compromise between high recovery, low utility costs, and process simplicity (and hence low capital investment). In U.S. Pat. No. 2,952,984 Marshall describes an LNG process capable of very high ethane recovery via the use of a refluxed distillation column. Markbreiter describes in U.S. Pat. No. 3,837,172 a simpler process using a non-refluxed fractionation column, limited to lower ethane or propane recoveries. Rambo et al describe in U.S. Pat. No. 5,114,451 an LNG process capable of very high ethane or very high propane recovery using a compressor to provide reflux for the distillation column.

The present invention is generally concerned with the recovery of ethylene, ethane, propylene, propane, and heavier hydrocarbons from such LNG streams. It uses a novel process arrangement to allow high ethane or high propane recovery while keeping the processing equipment simple and the capital investment low. Further, the present invention offers a reduction in the utilities (power and heat) required to process the LNG to give lower operating cost than the prior art processes. A typical analysis of an LNG stream to be processed in accordance with this invention would be, in approximate mole percent, 86.7% methane, 8.9% ethane and other $C_2$ components, 2.9% propane and other $C_3$ components, and 1.0% butanes plus, with the balance made up of nitrogen.

For a better understanding of the present invention, reference is made to the following examples and drawings. Referring to the drawings:

FIGS. 1, 2, and 3 are flow diagrams of prior art LNG processing plants in accordance with U.S. Pat. No. 3,837,172;

FIGS. 4, 5, and 6 are flow diagrams of prior art LNG processing plants in accordance with U.S. Pat. No. 2,952,984;

FIGS. 7, 8, and 9 are flow diagrams of prior art LNG processing plants in accordance with U.S. Pat. No. 5,114,451;

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the International System of Units (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Figure 1:
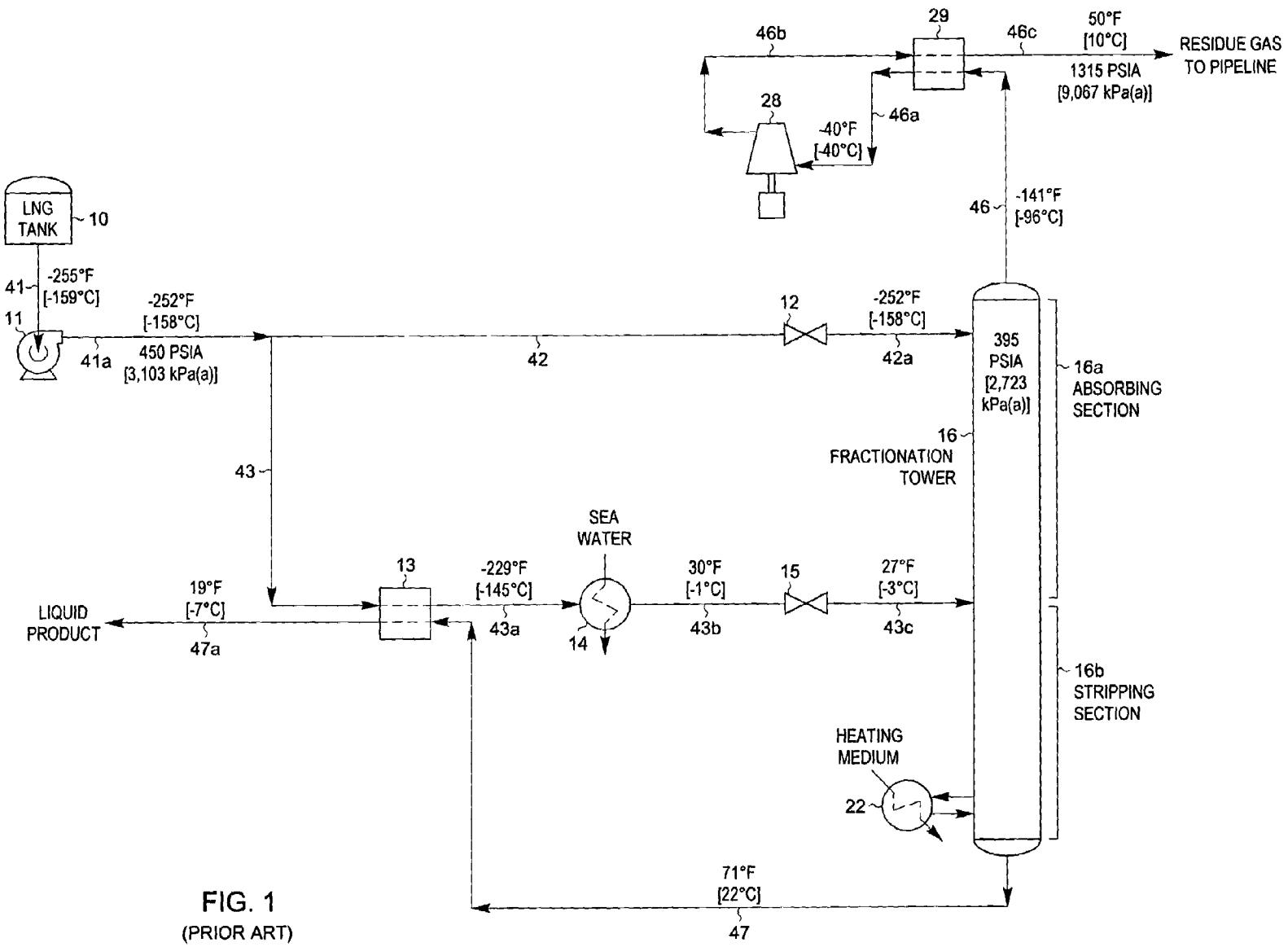
FIG. 1 (PRIOR ART)

Referring now to FIG. 1, for comparison purposes we begin with an example of an LNG processing plant in accordance with U.S. Pat. No. 3,837,172, adapted to produce an NGL product containing the majority of the $C_2$ components and heavier hydrocarbon components present in the feed stream. The LNG to be processed (stream 41) from LNG tank 10 enters pump 11 at −255° F. [−159° C.]. Pump 11 elevates the pressure of the LNG sufficiently so that it can flow through heat exchangers and thence to fractionation tower 16. Stream 41*a* exiting the pump is split into two portions, streams 42 and 43. The first portion, stream 42, is expanded to the operating pressure (approximately 395 psia [2,723 kPa(a)]) of fractionation tower 16 by valve 12 and supplied to the tower as the top column feed.

The second portion, stream 43, is heated prior to entering fractionation tower 16 so that all or a portion of it is vaporized, reducing the amount of liquid flowing down fractionation tower 16 and allowing the use of a smaller diameter column. In the example shown in FIG. 1, stream 43 is first heated to −229° F. [−145° C.] in heat exchanger 13 by cooling the liquid product from the column (stream 47). The partially heated stream 43*a* is then further heated to 30° F. [−1° C.] (stream 43*b*) in heat exchanger 14 using a low level source of utility heat, such as the sea water used in this example. After expansion to the operating pressure of fractionation tower 16 by valve 15, the resulting stream 43*c* flows to a mid-column feed point at 27° F. [−3° C.].

Fractionation tower 16, commonly referred to as a demethanizer, is a conventional distillation column containing a plurality of vertically spaced trays, one or more packed beds, or some combination of trays and packing. The trays and/or packing provide the necessary contact between the liquids falling downward in the column and the vapors rising upward. As shown in FIG. 1, the fractionation tower may consist of two sections. The upper absorbing (rectification) section 16*a* contains the trays and/or packing to provide the necessary contact between the vapors rising upward and cold liquid falling downward to condense and absorb the ethane and heavier components; the lower stripping (demethanizing) section 16*b* contains the trays and/or packing to provide the necessary contact between the liquids falling downward and the vapors rising upward. The demethanizing section also includes one or more reboilers (such as reboiler 22) which heat and vaporize a portion of the liquids flowing down the column to provide the stripping vapors which flow up the column. These vapors strip the methane from the liquids, so that the bottom liquid product (stream 47) is substantially devoid of methane and comprised of the majority of the $C_2$ components and heavier hydrocarbons contained in the LNG feed stream. (Because of the temperature level required in the column reboiler, a high level source of utility heat is typically required to provide the heat input to the reboiler, such as the heating medium used in this example.) The liquid product stream 47 exits the bottom of the tower at 71° F. [22° C.], based on a typical specification of a methane to ethane ratio of 0.005:1 on a volume basis in the bottom product. After cooling to 19° F. [−7° C.] in heat exchanger 13 as described previously, the liquid product (stream 47*a*) flows to storage or further processing.

The demethanizer overhead vapor, stream 46, is the methane-rich residue gas, leaving the column at −141° F. [−96° C.]. After being heated to −40° F. [−40° C.] in cross exchanger 29 so that conventional metallurgy may be used in compressor 28, stream 46*a* enters compressor 28 (driven by a supplemental power source) and is compressed to sales line pressure (stream 46*b*). Following cooling to 50° F. [10° C.] in cross exchanger 29, the residue gas product (stream 46*c*) flows to the sales gas pipeline at 1315 psia [9,067 kPa(a)] for subsequent distribution.

The relative split of the LNG into streams 42 and 43 is typically adjusted to maintain the desired recovery level of the desired $C_2$ components and heavier hydrocarbon components in the bottom liquid product (stream 47). Increasing the split to stream 42 feeding the top of fractionation tower 16 will increase the recovery level, until a point is reached where the composition of demethanizer overhead vapor (stream 46) is in equilibrium with the composition of the LNG (i.e., the composition of the liquid in stream 42*a*). Once this point has been reached, further increasing the split to stream 42 will not raise the recovery any further, but will simply increase the amount of high level utility heat required in reboiler 22 because less of the LNG is split to stream 43 and heated with low level utility heat in heat exchanger 14. (High level utility heat is normally more expensive than low level utility heat, so lower operating cost is usually achieved when the use of low level heat is maximized and the use of high level heat is minimized.) For the process conditions shown in FIG. 1, the amount of LNG split to stream 42 has been set at just slightly less than this maximum amount, so that the prior art process can achieve its maximum recovery without unduly increasing the heat load in reboiler 22.

A summary of stream flow rates and energy consumption for the process illustrated in FIG. 1 is set forth in the following table:

TABLE I (FIG. 1) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 4,286 | 440 | 145 | 49 | 4,941 |
| 43 | 5,238 | 537 | 177 | 60 | 6,038 |
| 46 | 9,513 | 54 | 4 | 0 | 9,618 |
| 47 | 11 | 923 | 318 | 109 | 1,361 |
| Recoveries* | | | | | |
| Ethane | 94.43% | | | | |
| Propane | 99.03% | | | | |
| Butanes+ | 99.78% | | | | |
| Power | | | | | |
| LNG Feed Pump | | 276 HP | | [454 kW] | |
| Residue Gas Compressor | | 5,267 HP | | [8,659 kW] | |
| Totals | | 5,543 HP | | [9,113 kW] | |
| Low Level Utility Heat | | | | | |
| LNG Heater | | 34,900 MBTU/Hr | | [22,546 kW] | |
| High Level Utility Heat | | | | | |
| Demethanizer Reboiler | | 8,280 MBTU/Hr | | [5,349 kW] | |

*(Based on un-rounded flow rates)

Figure 2:
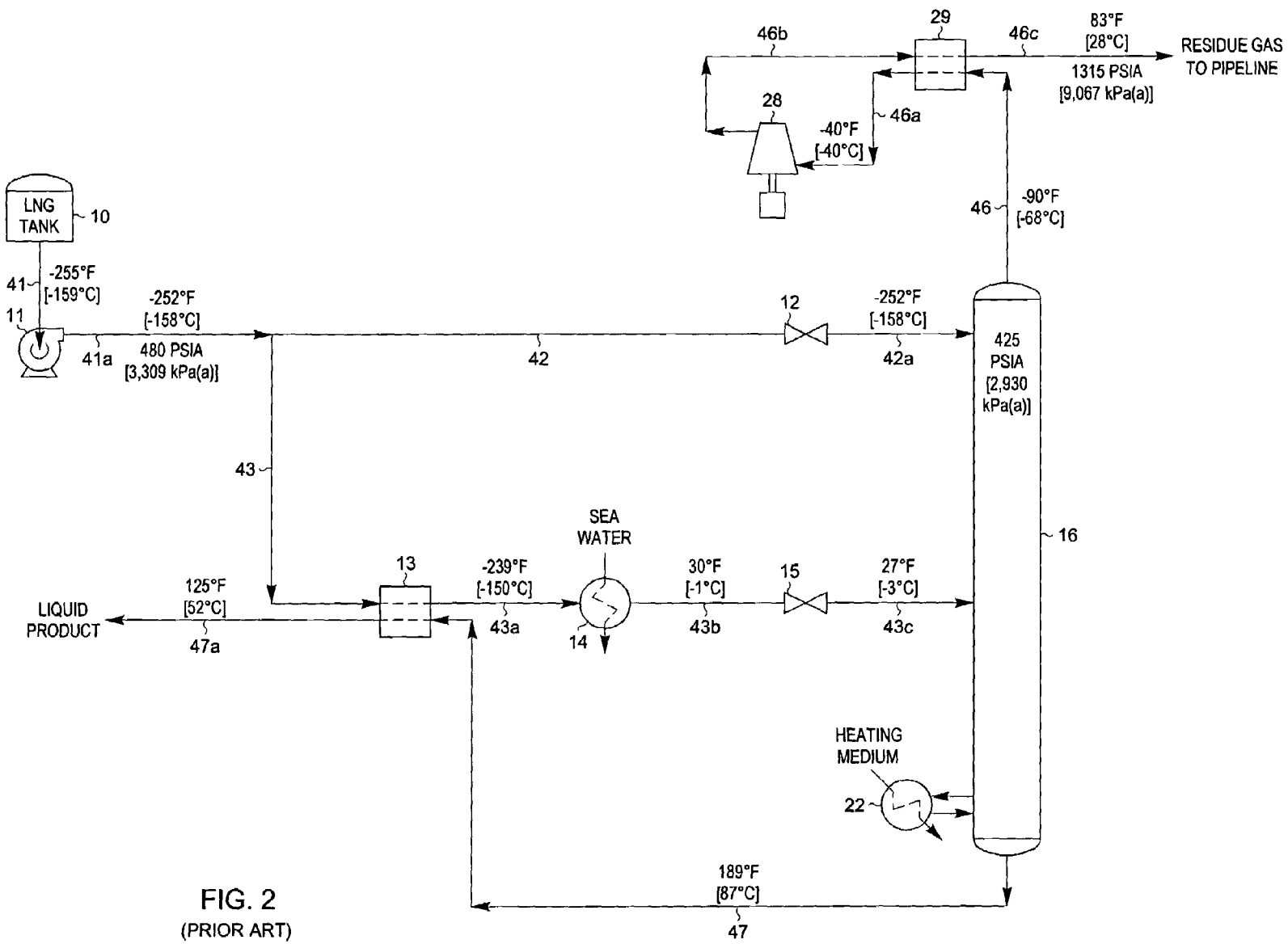
FIG. 2 (PRIOR ART)

This prior art process can also be adapted to produce an LPG product containing the majority of the $C_3$ components and heavier hydrocarbon components present in the feed stream as shown in FIG. 2. The processing scheme for the FIG. 2 process is essentially the same as that used for the FIG. 1 process described previously. The only significant differences are that the heat input of reboiler 22 has been increased to strip the $C_2$ components from the liquid product (stream 47) and the operating pressure of fractionation tower 16 has been raised slightly.

The liquid product stream 47 exits the bottom of fractionation tower 16 (commonly referred to as a deethanizer when producing an LPG product) at 189° F. [87° C.], based on a typical specification of an ethane to propane ratio of 0.020:1 on a molar basis in the bottom product. After cooling to 125° F. [52° C.] in heat exchanger 13, the liquid product (stream 47*a*) flows to storage or further processing.

The deethanizer overhead vapor (stream 46) leaves the column at −90° F. [−68° C.], is heated to −40° F. [−40° C.] in cross exchanger 29 (stream 46*a*), and is compressed by compressor 28 to sales line pressure (stream 46*b*). Following cooling to 83° F. [28° C.] in cross exchanger 29, the residue gas product (stream 46*c*) flows to the sales gas pipeline at 1315 psia [9,067 kPa(a)] for subsequent distribution.

A summary of stream flow rates and energy consumption for the process illustrated in FIG. 2 is set forth in the following table:

TABLE II (FIG. 2) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 4,286 | 440 | 145 | 49 | 4,941 |
| 43 | 5,238 | 537 | 177 | 60 | 6,038 |

TABLE II-continued

| (FIG. 2) Stream Flow Summary - Lb. Moles/Hr [kg moles/Hr] | | | | | |
|---|---|---|---|---|---|
| 46 | 9,524 | 971 | 14 | 1 | 10,557 |
| 47 | 0 | 6 | 308 | 108 | 422 |
| Recoveries* | | | | | |
| Propane | | 95.78% | | | |
| Butanes+ | | 99.09% | | | |
| Power | | | | | |
| LNG Feed Pump | | | 298 HP | | [490 kW] |
| Residue Gas Compressor | | | 5,107 HP | | [8,396 kW] |
| Totals | | | 5,405 HP | | [8,886 kW] |
| Low Level Utility Heat | | | | | |
| LNG Heater | | | 35,536 MBTU/Hr | | [22,956 kW] |
| High Level Utility Heat | | | | | |
| Deethanizer Reboiler | | | 16,525 MBTU/Hr | | [10,675 kW] |

*(Based on un-rounded flow rates)

Figure 3:
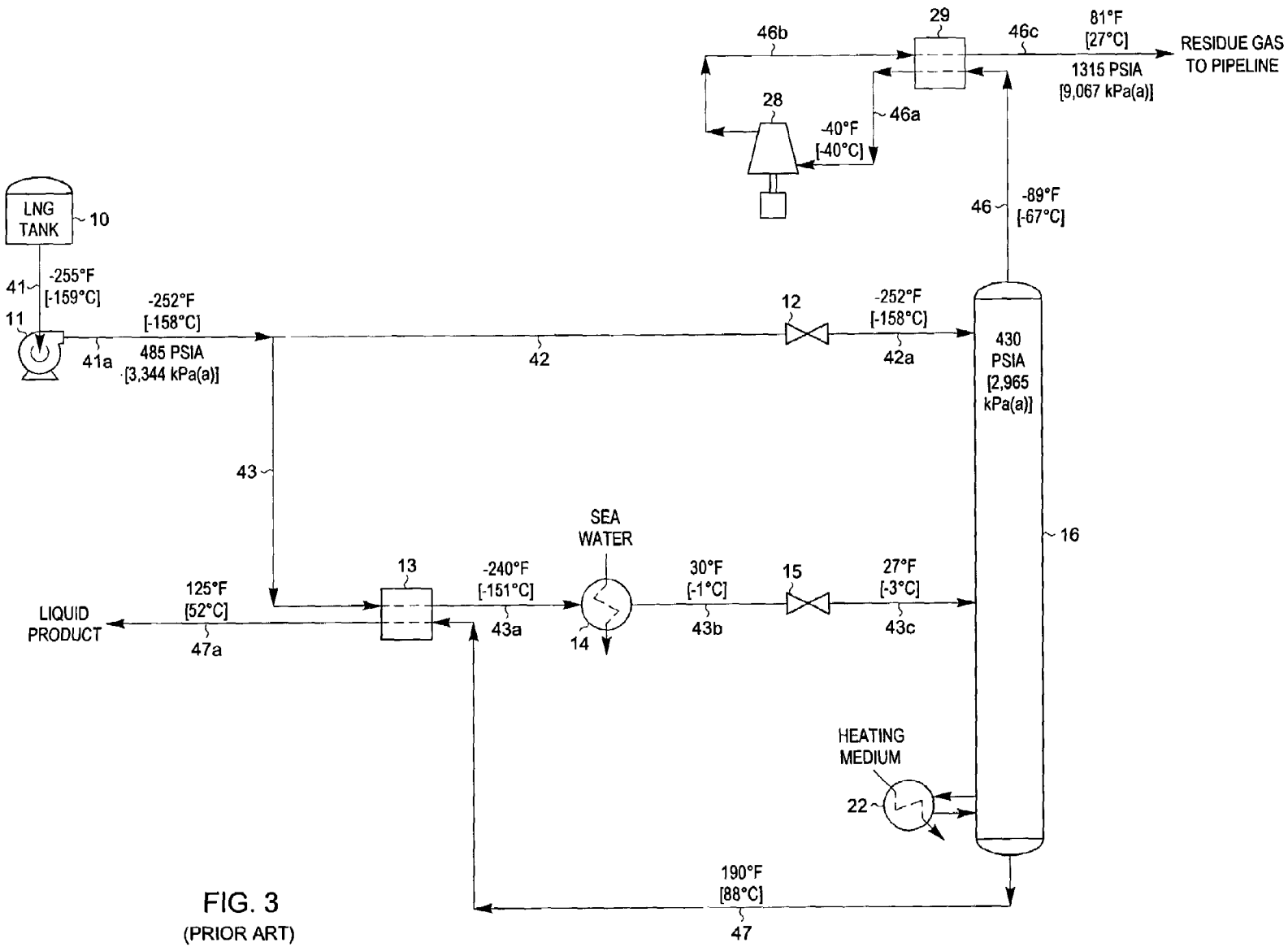
FIG. 3 (PRIOR ART)

If a slightly lower recovery level is acceptable, this prior art process can produce an LPG product using less power and high level utility heat as shown in FIG. 3. The processing scheme for the FIG. 3 process is essentially the same as that used for the FIG. 2 process described previously. The only significant difference is that the relative split between stream 42 and 43 has been adjusted to minimize the duty of reboiler 22 while providing the desired recovery of the $C_3$ components and heavier hydrocarbon components.

A summary of stream flow rates and energy consumption for the process illustrated in FIG. 3 is set forth in the following table:

TABLE III

| (FIG. 3) Stream Flow Summary - Lb. Moles/Hr [kg moles/Hr] | | | | | |
|---|---|---|---|---|---|
| Stream | Methane | Ethane | Propane | Butanes+ | Total |
| 41 | 9,524 | 977 | 322 | 109 | 10,979 |
| 42 | 3,604 | 370 | 122 | 41 | 4,155 |
| 43 | 5,920 | 607 | 200 | 68 | 6,824 |
| 46 | 9,524 | 971 | 16 | 1 | 10,559 |
| 47 | 0 | 6 | 306 | 108 | 420 |
| Recoveries* | | | | | |
| Propane | | 95.00% | | | |
| Butanes+ | | 99.04% | | | |
| Power | | | | | |
| LNG Feed Pump | | | 302 HP | | [496 kW] |
| Residue Gas Compressor | | | 5,034 HP | | [8,276 kW] |
| Totals | | | 5,336 HP | | [8,772 kW] |
| Low Level Utility Heat | | | | | |
| LNG Heater | | | 40,247 MBTU/Hr | | [26,000 kW] |
| High Level Utility Heat | | | | | |
| Deethanizer Reboiler | | | 11,827 MBTU/Hr | | [7,640 kW] |

*(Based on un-rounded flow rates)

Figure 4:
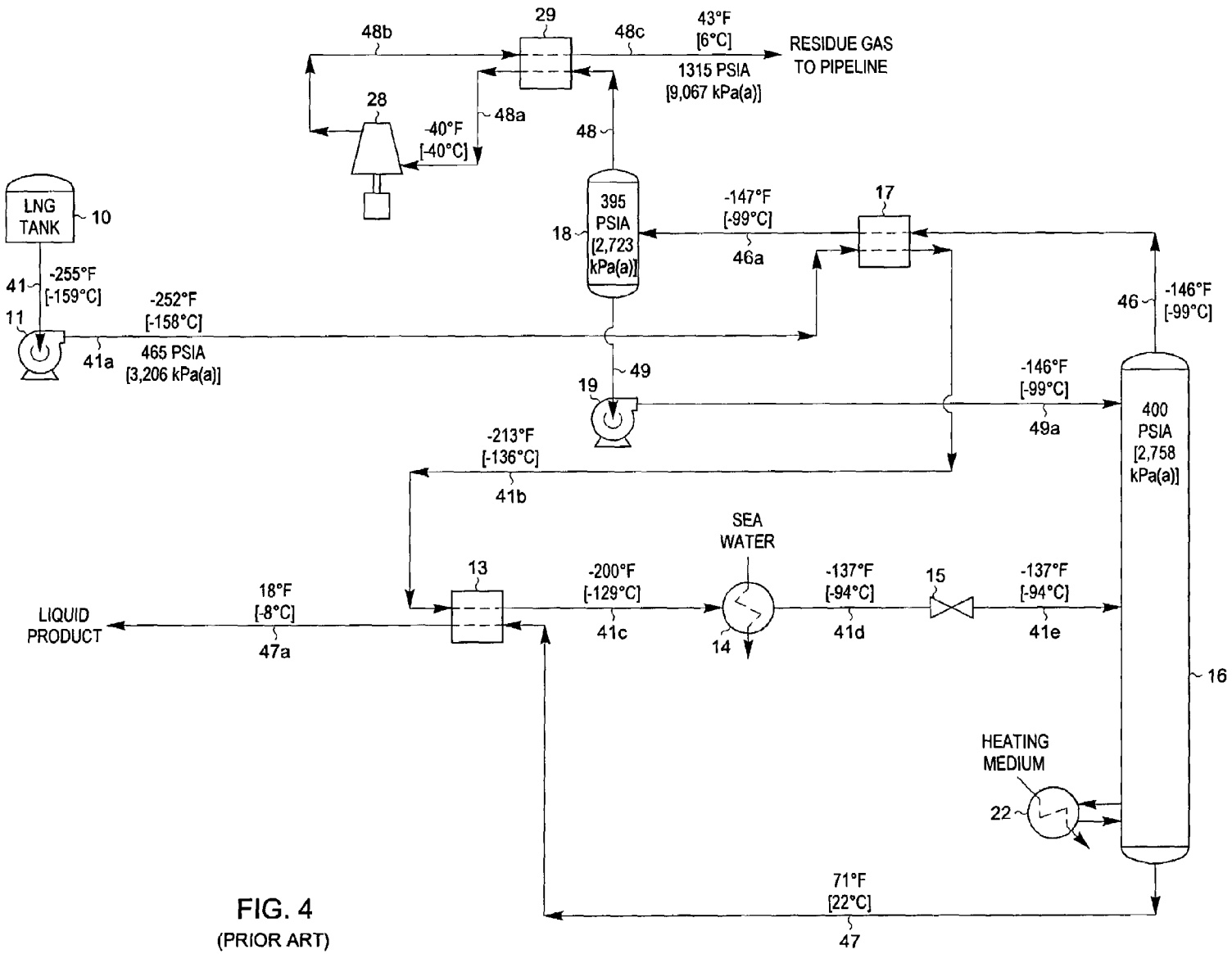
FIG. 4 (PRIOR ART)

FIG. 4 shows an alternative prior art process in accordance with U.S. Pat. No. 2,952,984 that can achieve higher recovery levels than the prior art process used in FIG. 1. The process of FIG. 4, adapted here to produce an NGL product containing the majority of the $C_2$ components and heavier hydrocarbon components present in the feed stream, has been applied to the same LNG composition and conditions as described previously for FIG. 1.

In the simulation of the FIG. 4 process, the LNG to be processed (stream 41) from LNG tank 10 enters pump 11 at −255° F. [−159° C.]. Pump 11 elevates the pressure of the LNG sufficiently so that it can flow through heat exchangers and thence to fractionation tower 16. Stream 41*a* exiting the pump is heated first to −213° F. [−136° C.] in reflux condenser 17 as it provides cooling to the overhead vapor (stream 46) from fractionation tower 16. The partially heated stream 41*b* is then heated to −200° F. [−129° C.] (stream 41*c*) in heat exchanger 13 by cooling the liquid product from the column (stream 47), and then further heated to −137° F. [−94° C.] (stream 41*d*) in heat exchanger 14 using low level utility heat. After expansion to the operating pressure (approximately 400 psia [2,758 kPa(a)]) of fractionation tower 16 by valve 15, stream 41*e* flows to a mid-column feed point at its bubble point, approximately −137° F. [−94° C.].

Overhead stream 46 leaves the upper section of fractionation tower 16 at −146° F. [−99° C.] and flows to reflux condenser 17 where it is cooled to −147° F. [−99° C.] and partially condensed by heat exchange with the cold LNG (stream 41*a*) as described previously. The partially condensed stream 46*a* enters reflux separator 18 wherein the condensed liquid (stream 49) is separated from the uncondensed vapor (stream 48). The liquid stream 49 from reflux separator 18 is pumped by reflux pump 19 to a pressure slightly above the operating pressure of demethanizer 16 and stream 49*a* is then supplied as cold top column feed (reflux) to demethanizer 16. This cold liquid reflux absorbs and condenses the $C_2$ components and heavier hydrocarbon components from the vapors rising in the upper rectification section of demethanizer 16.

The liquid product stream 47 exits the bottom of fractionation tower 16 at 71° F. [22° C.], based on a methane to ethane ratio of 0.005:1 on a volume basis in the bottom product. After cooling to 18° F. [−8° C.] in heat exchanger 13 as described previously, the liquid product (stream 47*a*) flows to storage or further processing. The residue gas (stream 48) leaves reflux separator 18 at −147° F. [−99° C.], is heated to −40° F. [−40° C.] in cross exchanger 29 (stream 48*a*), and is compressed by compressor 28 to sales line pressure (stream 48*b*). Following cooling to 43° F. [6° C.] in cross exchanger 29, the residue gas product (stream 48*c*) flows to the sales gas pipeline at 1315 psia [9,067 kPa(a)] for subsequent distribution.

A summary of stream flow rates and energy consumption for the process illustrated in FIG. 4 is set forth in the following table:

TABLE IV

| (FIG. 4) Stream Flow Summary - Lb. Moles/Hr [kg moles/Hr] | | | | | |
|---|---|---|---|---|---|
| Stream | Methane | Ethane | Propane | Butanes+ | Total |
| 41 | 9,524 | 977 | 322 | 109 | 10,979 |
| 46 | 12,476 | 3 | 0 | 0 | 12,531 |
| 49 | 2,963 | 2 | 0 | 0 | 2,970 |
| 48 | 9,513 | 1 | 0 | 0 | 9,561 |
| 47 | 11 | 976 | 322 | 109 | 1,418 |
| Recoveries* | | | | | |
| Ethane | | 99.90% | | | |
| Propane | | 100.00% | | | |
| Butanes+ | | 100.00% | | | |

TABLE IV-continued (FIG. 4) Stream Flow Summary - Lb. Moles/Hr [kg moles/Hr]

| | | |
|---|---|---|
| Power | | |
| LNG Feed Pump | 287 HP | [472 kW] |
| Reflux Pump | 9 HP | [15 kW] |
| Residue Gas Compressor | 5,248 HP | [8,627 kW] |
| Totals | 5,544 HP | [9,114 kW] |
| Low Level Utility Heat | | |
| LNG Heater | 11,265 MBTU/Hr | [7,277 kW] |
| High Level Utility Heat | | |
| Demethanizer Reboiler | 30,968 MBTU/Hr | [20,005 kW] |

*(Based on un-rounded flow rates)

Comparing the recovery levels displayed in Table IV above for the FIG. 4 prior art process with those in Table I for the FIG. 1 prior art process shows that the FIG. 4 process can achieve substantially higher ethane, propane, and butanes+recoveries. However, comparing the utilities consumptions in Table IV with those in Table I shows that the high level utility heat required for the FIG. 4 process is much higher than that for the FIG. 1 process because the FIG. 4 process does not allow for optimum use of low level utility heat.

Figure 5:
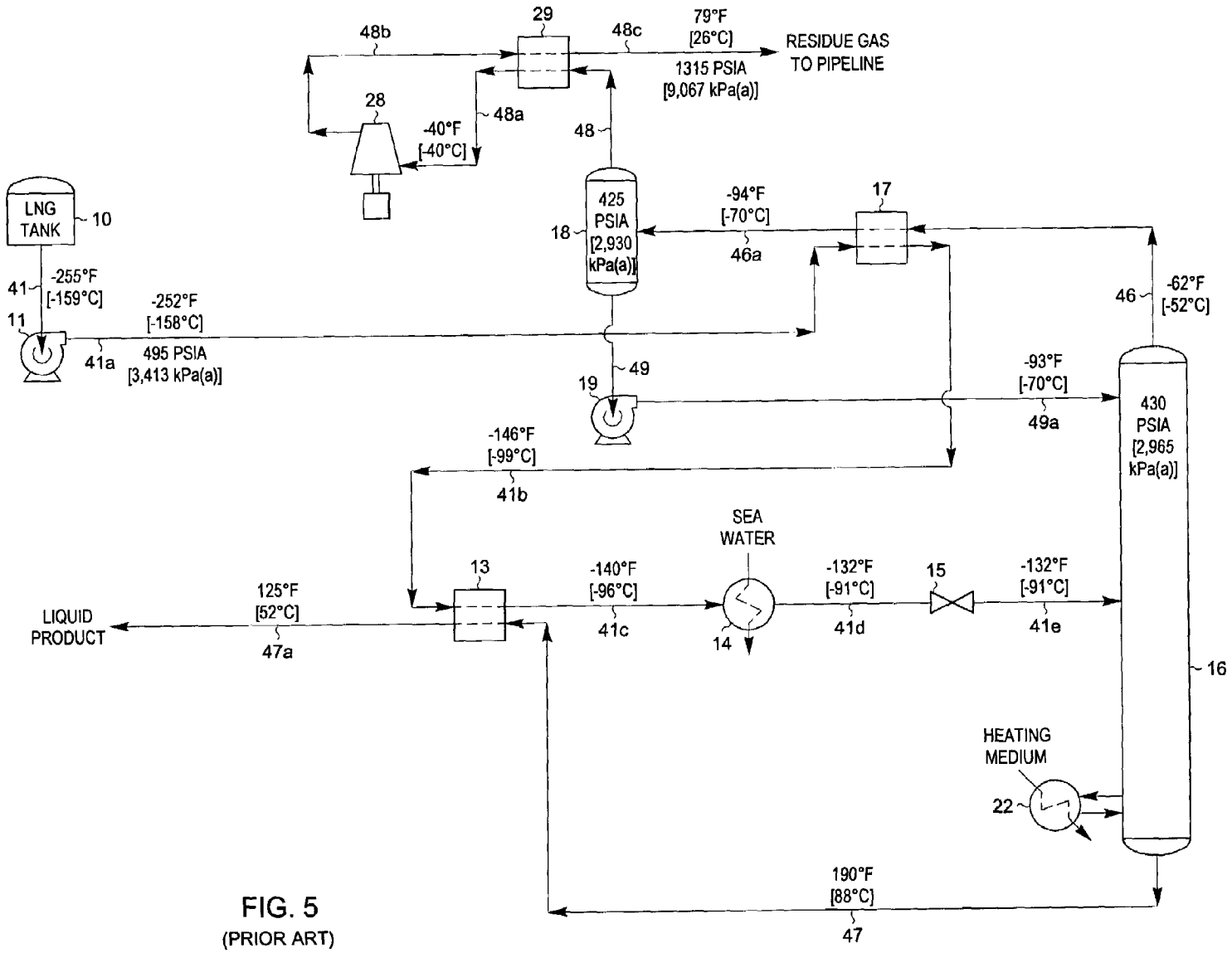
FIG. 5 (PRIOR ART)

This prior art process can also be adapted to produce an LPG product containing the majority of the $C_3$ components and heavier hydrocarbon components present in the feed stream as shown in FIG. 5. The processing scheme for the FIG. 5 process is essentially the same as that used for the FIG. 4 process described previously. The only significant differences are that the heat input of reboiler 22 has been increased to strip the $C_2$ components from the liquid product (stream 47) and the operating pressure of fractionation tower 16 has been raised slightly. The LNG composition and conditions are the same as described previously for FIG. 2.

The liquid product stream 47 exits the bottom of deethanizer 16 at 190° F. [88° C.], based on an ethane to propane ratio of 0.020:1 on a molar basis in the bottom product. After cooling to 125° F. [52° C.] in heat exchanger 13, the liquid product (stream 47*a*) flows to storage or further processing. The residue gas (stream 48) leaves reflux separator 18 at −94° F. [−70° C.], is heated to −40° F. [−40° C.] in cross exchanger 29 (stream 48*a*), and is compressed by compressor 28 to sales line pressure (stream 48*b*). Following cooling to 79° F. [26° C.] in cross exchanger 29, the residue gas product (stream 48*c*) flows to the sales gas pipeline at 1315 psia [9,067 kPa(a)] for subsequent distribution.

A summary of stream flow rates and energy consumption for the process illustrated in FIG. 5 is set forth in the following table:

TABLE V (FIG. 5) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 46 | 11,401 | 2,783 | 3 | 0 | 14,238 |
| 49 | 1,877 | 1,812 | 3 | 0 | 3,696 |
| 48 | 9,524 | 971 | 0 | 0 | 10,542 |
| 47 | 0 | 6 | 322 | 109 | 437 |

TABLE V-continued (FIG. 5) Stream Flow Summary - Lb. Moles/Hr [kg moles/Hr]

| | | |
|---|---|---|
| Recoveries* | | |
| Propane | 99.90% | |
| Butanes+ | 100.00% | |
| Power | | |
| LNG Feed Pump | 309 HP | [508 kW] |
| Reflux Pump | 12 HP | [20 kW] |
| Residue Gas Compressor | 5,106 HP | [8,394 kW] |
| Totals | 5,427 HP | [8,922 kW] |
| Low Level Utility Heat | | |
| LNG Heater | 1,689 MBTU/Hr | [1,091 kW] |
| High Level Utility Heat | | |
| Deethanizer Reboiler | 49,883 MBTU/Hr | [32,225 kW] |

*(Based on un-rounded flow rates)

Figure 6:
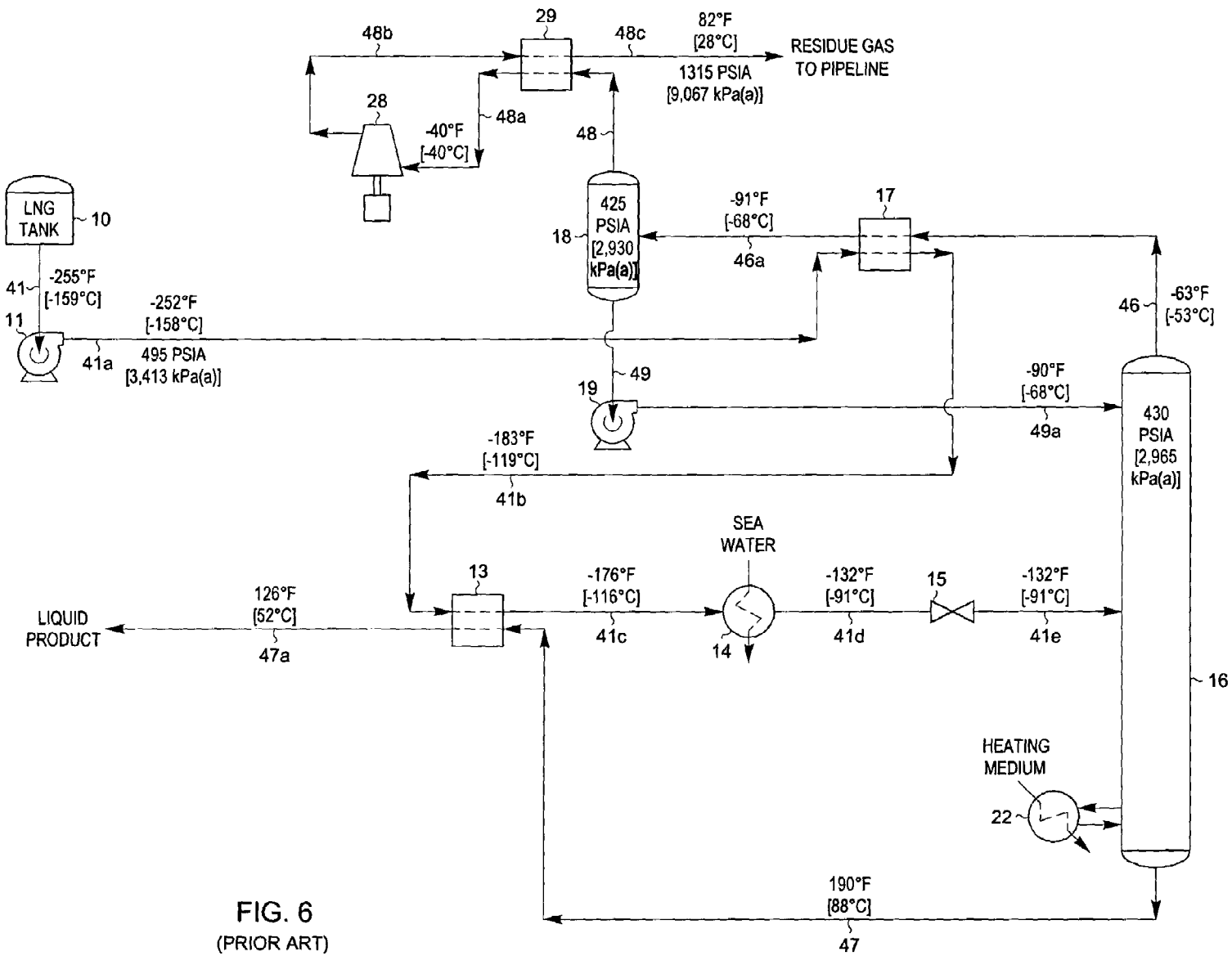
FIG. 6 (PRIOR ART)

If a slightly lower recovery level is acceptable, this prior art process can produce an LPG product using less power and high level utility heat as shown in FIG. 6. The processing scheme for the FIG. 6 process is essentially the same as that used for the FIG. 5 process described previously. The only significant difference is that the outlet temperature of stream 46*a* from reflux condenser 17 has been adjusted to minimize the duty of reboiler 22 while providing the desired recovery of the $C_3$ components and heavier hydrocarbon components. The LNG composition and conditions are the same as described previously for FIG. 3.

A summary of stream flow rates and energy consumption for the process illustrated in FIG. 6 is set forth in the following table:

TABLE VI (FIG. 6) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 46 | 10,485 | 1,910 | 97 | 0 | 12,541 |
| 49 | 961 | 939 | 81 | 0 | 1,983 |
| 48 | 9,524 | 971 | 16 | 0 | 10,558 |
| 47 | 0 | 6 | 306 | 109 | 421 |

| | | |
|---|---|---|
| Recoveries* | | |
| Propane | 95.00% | |
| Butanes+ | 100.00% | |
| Power | | |
| LNG Feed Pump | 309 HP | [508 kW] |
| Reflux Pump | 7 HP | [12 kW] |
| Residue Gas Compressor | 5,108 HP | [8,397 kW] |
| Totals | 5,424 HP | [8,917 kW] |
| Low Level Utility Heat | | |
| LNG Heater | 8,230 MBTU/Hr | [5,317 kW] |
| High Level Utility Heat | | |
| Deethanizer Reboiler | 43,768 MBTU/Hr | [28,274 kW] |

*(Based on un-rounded flow rates)

Figure 7:
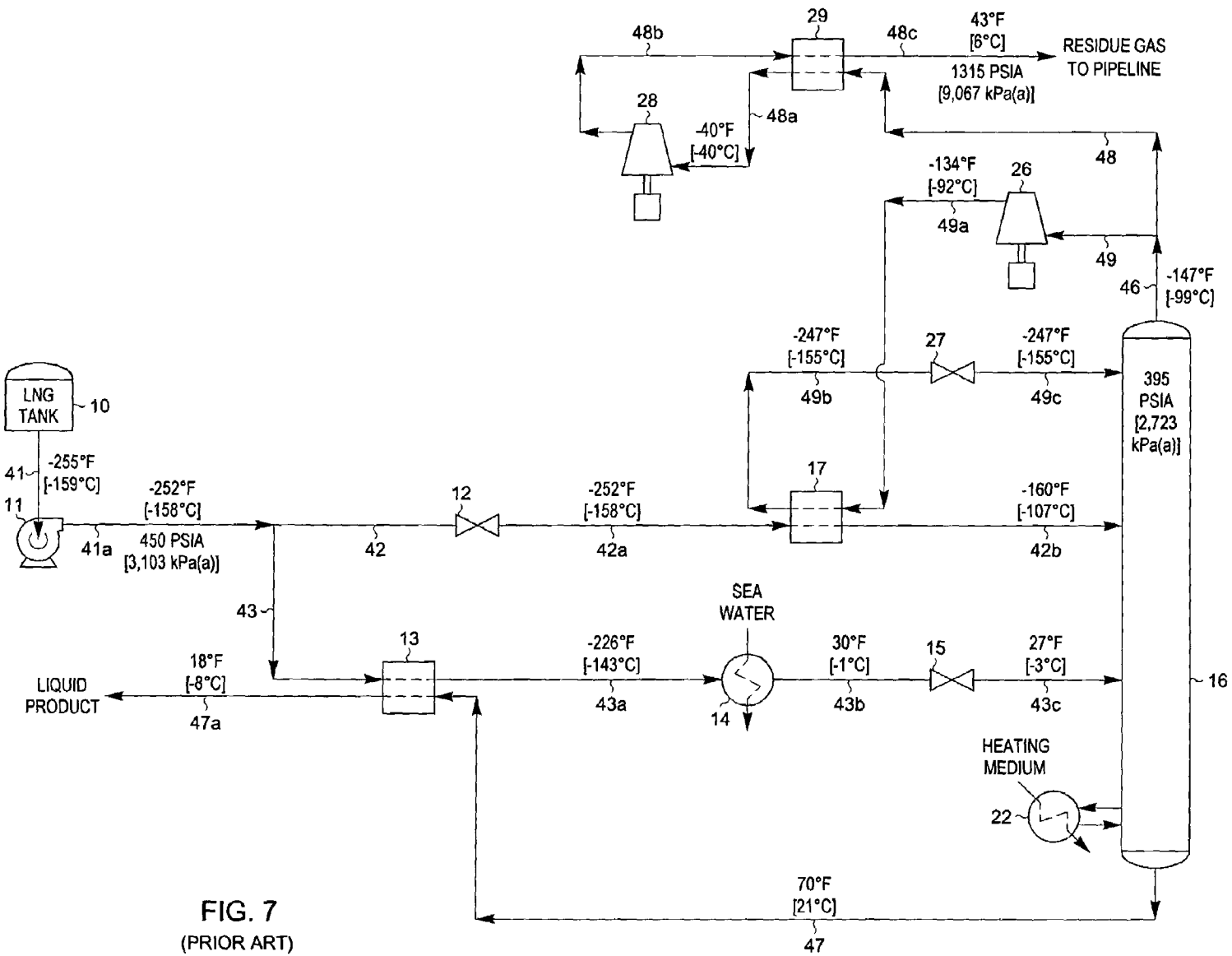
FIG. 7 (PRIOR ART)

FIG. 7 shows another alternative prior art process in accordance with U.S. Pat. No. 5,114,451 that can also achieve higher recovery levels than the prior art process used in FIG. 1. The process of FIG. 7, adapted here to produce an NGL product containing the majority of the $C_2$ components and heavier hydrocarbon components present in the feed stream, has been applied to the same LNG composition and conditions as described previously for FIGS. 1 and 4.

In the simulation of the FIG. 7 process, the LNG to be processed (stream 41) from LNG tank 10 enters pump 11 at −255° F. [−159° C.]. Pump 11 elevates the pressure of the LNG sufficiently so that it can flow through heat exchangers and thence to fractionation tower 16. Stream 41*a* exiting the pump is split into two portions, streams 42 and 43. The second portion, stream 43, is heated prior to entering fractionation tower 16 so that all or a portion of it is vaporized, reducing the amount of liquid flowing down fractionation tower 16 and allowing the use of a smaller diameter column. In the example shown in FIG. 7, stream 43 is first heated to −226° F. [−143° C.] in heat exchanger 13 by cooling the liquid product from the column (stream 47). The partially heated stream 43*a* is then further heated to 30° F. [−1° C.] (stream 43*b*) in heat exchanger 14 using low level utility heat. After expansion to the operating pressure (approximately 395 psia [2,723 kPa(a)]) of fractionation tower 16 by valve 15, stream 43*c* flows to a lower mid-column feed point at 27° F. [−3° C.].

The proportion of the total feed in stream 41*a* flowing to the column as stream 42 is controlled by valve 12, and is typically 50% or less of the total feed. Stream 42*a* flows from valve 12 to heat exchanger 17 where it is heated as it cools, substantially condenses, and subcools stream 49*a*. The heated stream 42*b* then flows to demethanizer 16 at an upper mid-column feed point at −160° F. [−107° C.].

Tower overhead stream 46 leaves demethanizer 16 at −147° F. [−99° C.] and is divided into two portions. The major portion, stream 48, is the methane-rich residue gas. It is heated to −40° F. [−40° C.] in cross exchanger 29 (stream 48*a*) and compressed by compressor 28 to sales line pressure (stream 48*b*). Following cooling to 43° F. [6° C.] in cross exchanger 29, the residue gas product (stream 48*c*) flows to the sales gas pipeline at 1315 psia [9,067 kPa(a)] for subsequent distribution.

The minor portion of the tower overhead, stream 49, enters compressor 26, which supplies a modest boost in pressure to overcome the pressure drops in heat exchanger 17 and control valve 27, as well as the static head due to the height of demethanizer 16. The compressed stream 49*a* is cooled to −247° F. [−155° C.] to substantially condense and subcool it (stream 49*b*) by a portion of the LNG feed (stream 42*a*) in heat exchanger 17 as described previously. Stream 49*b* flows through valve 27 to lower its pressure to that of fractionation tower 16, and resulting stream 49*c* flows to the top feed point of demethanizer 16 to serve as reflux for the tower.

The liquid product stream 47 exits the bottom of fractionation tower 16 at 70° F. [21° C.], based on a methane to ethane ratio of 0.005:1 on a volume basis in the bottom product. After cooling to 18° F. [−8° C.] in heat exchanger 13 as described previously, the liquid product (stream 47*a*) flows to storage or further processing.

A summary of stream flow rates and energy consumption for the process illustrated in FIG. 7 is set forth in the following table:

TABLE VII (FIG. 7) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 4,762 | 488 | 161 | 54 | 5,489 |
| 43 | 4,762 | 489 | 161 | 55 | 5,490 |
| 46 | 11,503 | 1 | 0 | 0 | 11,561 |
| 49 | 1,990 | 0 | 0 | 0 | 2,000 |
| 48 | 9,513 | 1 | 0 | 0 | 9,561 |
| 47 | 11 | 976 | 322 | 109 | 1,418 |

| Recoveries* | | | |
|---|---|---|---|
| Ethane | 99.88% | | |
| Propane | 100.00% | | |
| Butanes+ | 100.00% | | |
| Power | | | |
| LNG Feed Pump | | 276 HP | [454 kW] |
| Recycle Compressor | | 48 HP | [79 kW] |
| Residue Gas Compressor | | 5,249 HP | [8,629 kW] |
| Totals | | 5,573 HP | [9,162 kW] |
| Low Level Utility Heat | | | |
| LNG Heater | | 31,489 MBTU/Hr | [20,342 kW] |
| High Level Utility Heat | | | |
| Demethanizer Reboiler | | 10,654 MBTU/Hr | [6,883 kW] |

*(Based on un-rounded flow rates)

Comparing the recovery levels displayed in Table VII above for the FIG. 7 prior art process with those in Table I for the FIG. 1 prior art process shows that the FIG. 7 process can achieve substantially higher ethane, propane, and butanes+recoveries, essentially the same as those achieved by the FIG. 4 prior art process as shown in Table IV. Further, comparing the utilities consumptions in Table VII with those in Table IV shows that the high level utility heat required for the FIG. 7 process is much lower than that for the FIG. 4. In fact, the high level utility heat required for the FIG. 7 process is only about 29% higher than the FIG. 1 process.

Figure 8:
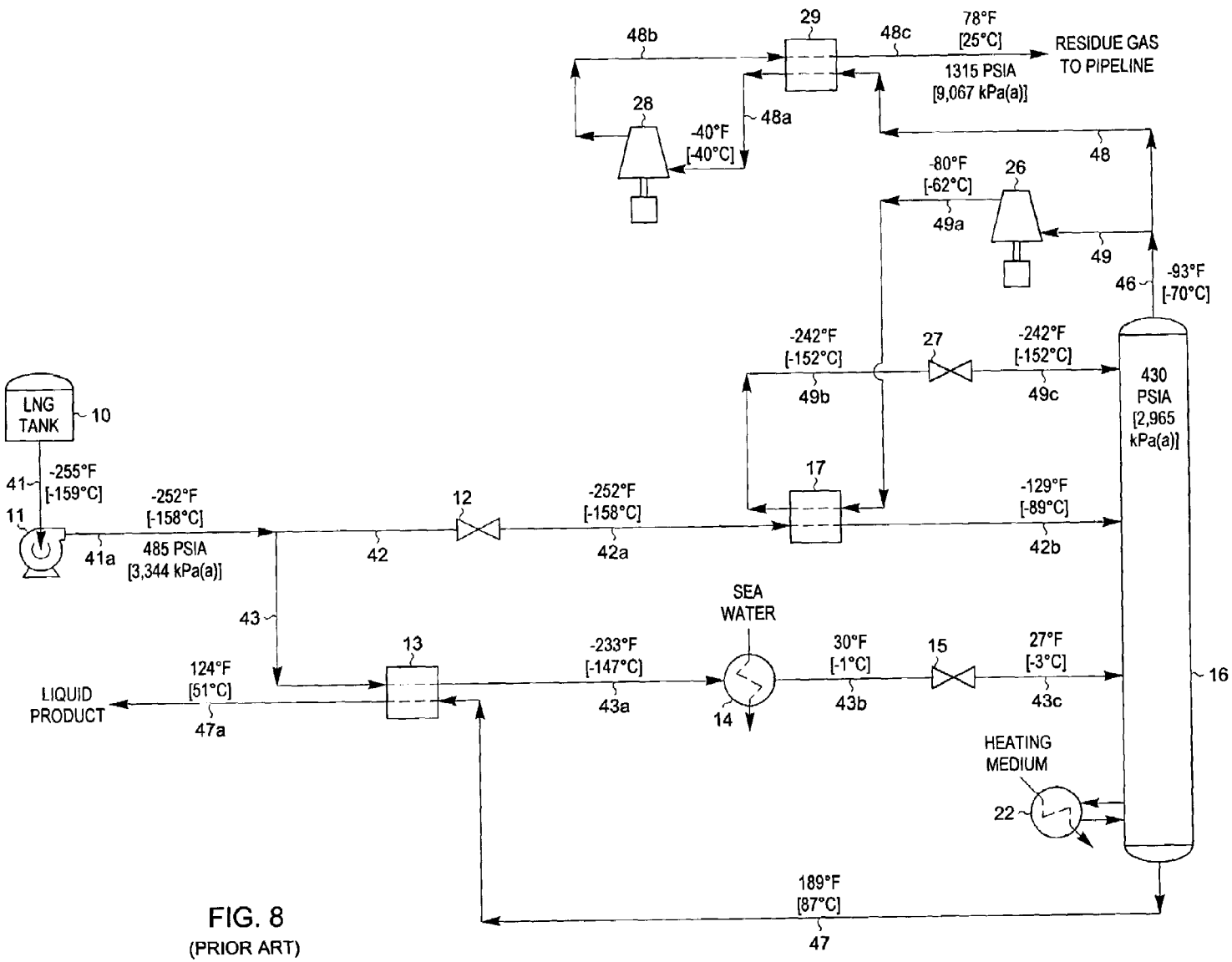
FIG. 8 (PRIOR ART)

This prior art process can also be adapted to produce an LPG product containing the majority of the $C_3$ components and heavier hydrocarbon components present in the feed stream as shown in FIG. 8. The processing scheme for the FIG. 8 process is essentially the same as that used for the FIG. 7 process described previously. The only significant differences are that the heat input of reboiler 22 has been increased to strip the $C_2$ components from the liquid product (stream 47), the relative split between stream 42 and 43 has been adjusted to minimize the duty of reboiler 22 while providing the desired recovery of the $C_3$ components and heavier hydrocarbon components, and the operating pressure of fractionation tower 16 has been raised slightly. The LNG composition and conditions are the same as described previously for FIGS. 2 and 5.

The liquid product stream 47 exits the bottom of deethanizer 16 at 189° F. [87° C.], based on an ethane to propane ratio of 0.020:1 on a molar basis in the bottom product. After cooling to 124° F. [51° C.] in heat exchanger 13, the liquid product (stream 47*a*) flows to storage or further processing. The residue gas (stream 48) at −93° F. [−70° C.] is heated to −40° F. [−40° C.] in cross exchanger 29 (stream 48*a*) and compressed by compressor 28 to sales line pressure (stream 48*b*). Following cooling to 78° F. [25° C.] in cross exchanger 29, the residue gas product (stream 48*c*) flows to the sales gas pipeline at 1315 psia [9,067 kPa(a)] for subsequent distribution.

A summary of stream flow rates and energy consumption for the process illustrated in FIG. 8 is set forth in the following table:

TABLE VIII (FIG. 8) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 5,714 | 586 | 193 | 65 | 6,587 |
| 43 | 3,810 | 391 | 129 | 44 | 4,392 |
| 46 | 12,676 | 1,292 | 0 | 0 | 14,032 |
| 49 | 3,152 | 321 | 0 | 0 | 3,490 |
| 48 | 9,524 | 971 | 0 | 0 | 10,542 |
| 47 | 0 | 6 | 322 | 109 | 437 |

| Recoveries* | | | |
|---|---|---|---|
| Propane | 99.90% | | |
| Butanes+ | 100.00% | | |
| Power | | | |
| LNG Feed Pump | 302 | HP | [496 kW] |
| Recycle Compressor | 104 | HP | [171 kW] |
| Residue Gas Compressor | 5,033 | HP | [8,274 kW] |
| Totals | 5,439 | HP | [8,941 kW] |
| Low Level Utility Heat | | | |
| LNG Heater | 25,468 | MBTU/Hr | [16,452 kW] |
| High Level Utility Heat | | | |
| Demethanizer Reboiler | 25,808 | MBTU/Hr | [16,672 kW] |

*(Based on un-rounded flow rates)

Figure 9:
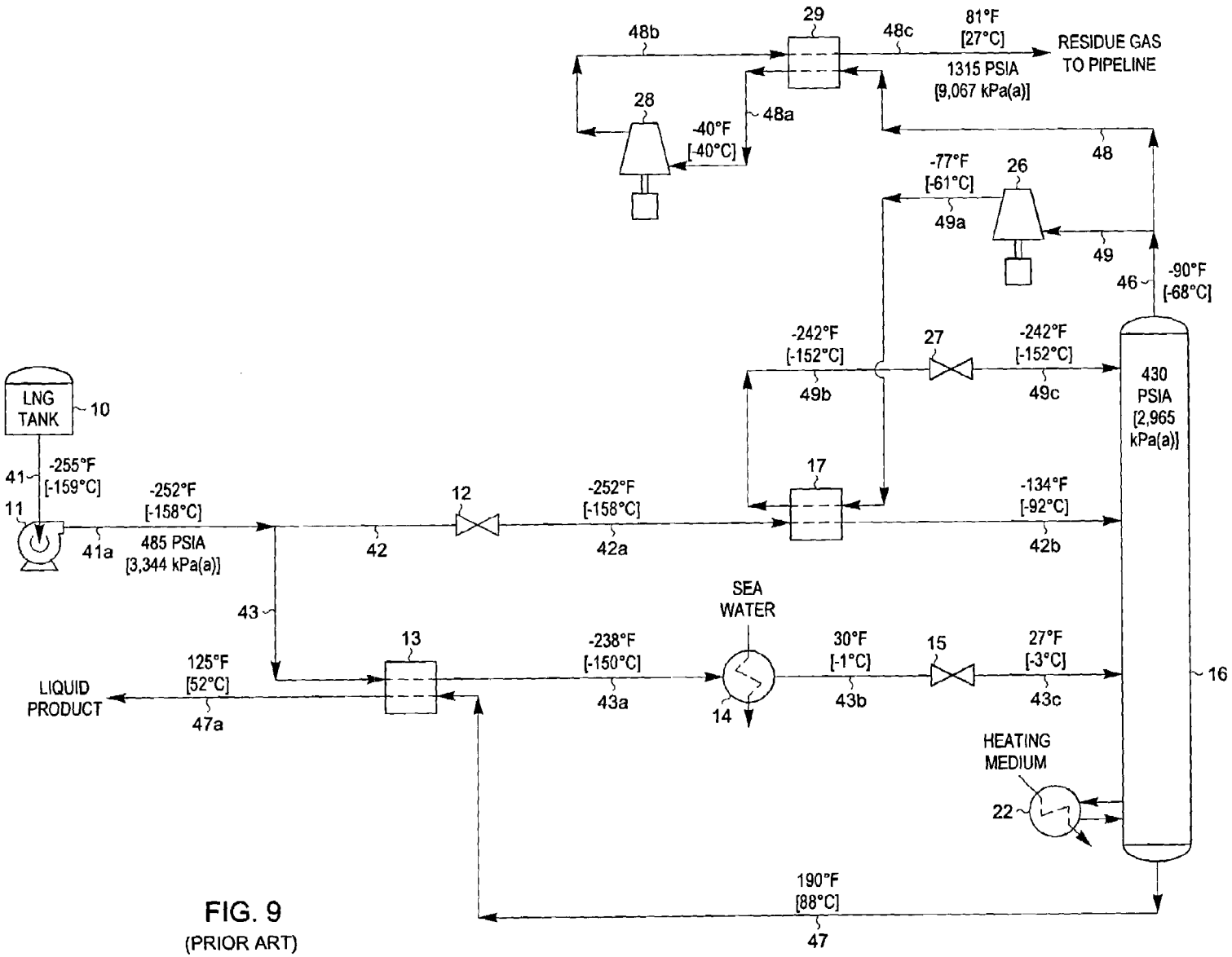
FIG. 9 (PRIOR ART)

If a slightly lower recovery level is acceptable, this prior art process can produce an LPG product using less power and high level utility heat as shown in FIG. 9. The processing scheme for the FIG. 9 process is essentially the same as that used for the FIG. 8 process described previously. The only significant differences are that the relative split between stream 42 and 43 and the flow rate of recycle stream 49 have been adjusted to minimize the duty of reboiler 22 while providing the desired recovery of the $C_3$ components and heavier hydrocarbon components. The LNG composition and conditions are the same as described previously for FIGS. 3 and 6.

A summary of stream flow rates and energy consumption for the process illustrated in FIG. 9 is set forth in the following table:

TABLE IX (FIG. 9) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 4,374 | 449 | 148 | 50 | 5,042 |
| 43 | 5,150 | 528 | 174 | 59 | 5,937 |
| 46 | 11,327 | 1,155 | 19 | 0 | 12,558 |
| 49 | 1,803 | 184 | 3 | 0 | 2,000 |
| 48 | 9,524 | 971 | 16 | 0 | 10,558 |
| 47 | 0 | 6 | 306 | 109 | 421 |

| Recoveries* | | | |
|---|---|---|---|
| Propane | 95.00% | | |
| Butanes+ | 100.00% | | |

TABLE IX-continued (FIG. 9) Stream Flow Summary - Lb. Moles/Hr [kg moles/Hr]

| Power | | | |
|---|---|---|---|
| LNG Feed Pump | 302 | HP | [496 kW] |
| Recycle Compressor | 61 | HP | [100 kW] |
| Residue Gas Compressor | 5,034 | HP | [8,276 kW] |
| Totals | 5,397 | HP | [8,872 kW] |
| Low Level Utility Heat | | | |
| LNG Heater | 34,868 | MBTU/Hr | [22,525 kW] |
| High Level Utility Heat | | | |
| Demethanizer Reboiler | 16,939 | MBTU/Hr | [10,943 kW] |

*(Based on un-rounded flow rates)

DESCRIPTION OF THE INVENTION

Example 1

Figure 10:
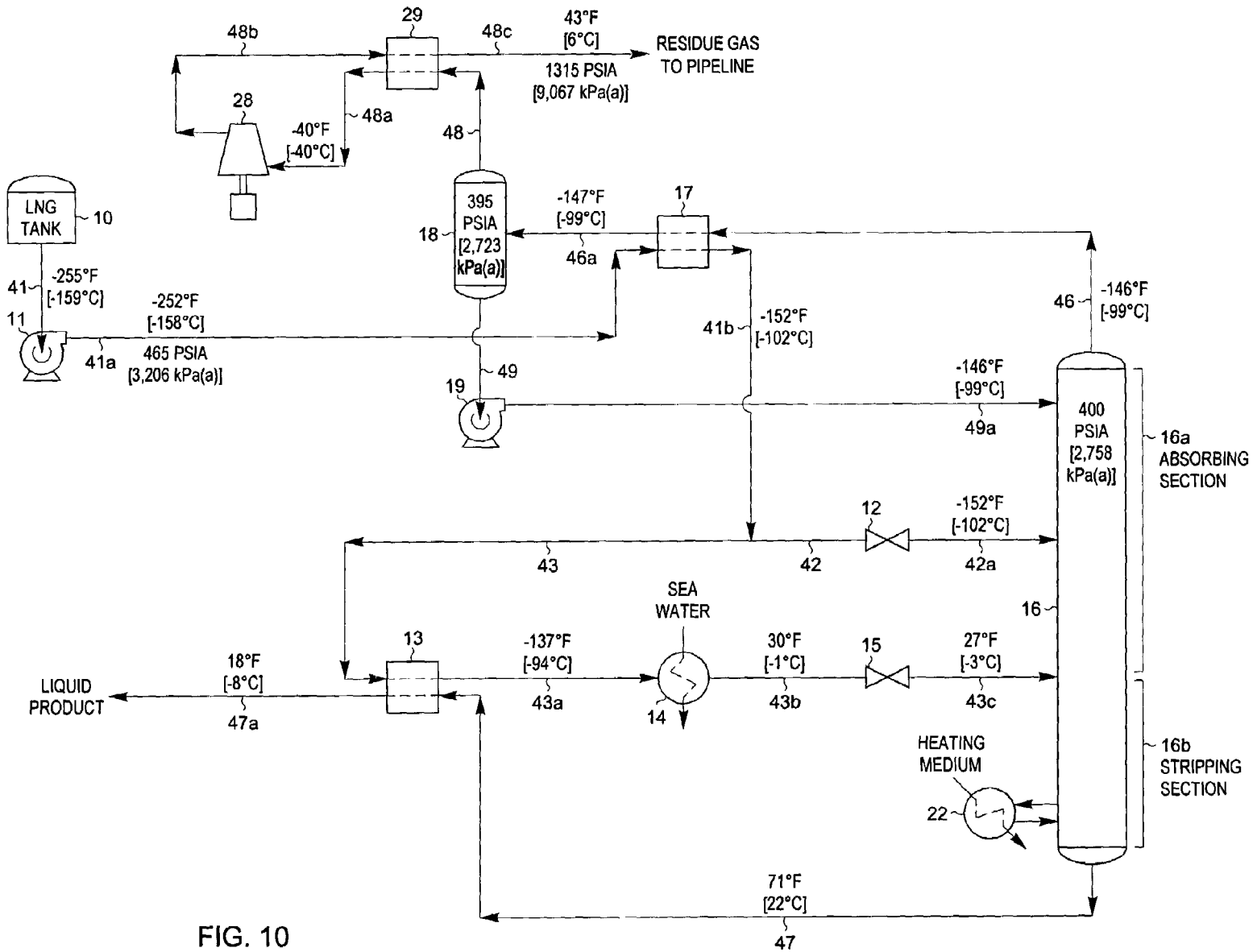
FIG. 10 is a flow diagram of an LNG processing plant in accordance with the present invention.

FIG. 10 illustrates a flow diagram of a process in accordance with the present invention. The LNG composition and conditions considered in the process presented in FIG. 10 are the same as those in FIGS. 1, 4, and 7. Accordingly, the FIG. 10 process can be compared with that of the FIGS. 1, 4, and 7 processes to illustrate the advantages of the present invention.

In the simulation of the FIG. 10 process, the LNG to be processed (stream 41) from LNG tank 10 enters pump 11 at −255° F. [−159° C.]. Pump 11 elevates the pressure of the LNG sufficiently so that it can flow through heat exchangers and thence to fractionation tower 16. Stream 41*a* exiting the pump is heated to −152° F. [−102° C.] in reflux condenser 17 as it provides cooling to the overhead vapor (stream 46) from fractionation tower 16. Stream 41*b* exiting reflux condenser 17 is split into two portions, streams 42 and 43. The first portion, stream 42, is expanded to the operating pressure (approximately 400 psia [2,758 kPa(a)]) of fractionation tower 16 by valve 12 and supplied to the tower at an upper mid-column feed point.

The second portion, stream 43, is heated prior to entering fractionation tower 16 so that all or a portion of it is vaporized, reducing the amount of liquid flowing down fractionation tower 16 and allowing the use of a smaller diameter column. In the example shown in FIG. 10, stream 43 is first heated to −137° F. [−94° C.] in heat exchanger 13 by cooling the liquid product from the column (stream 47). The partially heated stream 43*a* is then further heated to 30° F. [−1° C.] (stream 43*b*) in heat exchanger 14 using low level utility heat. After expansion to the operating pressure of fractionation tower 16 by valve 15, stream 43*c* flows to a lower mid-column feed point at 27° F. [−3° C.].

The demethanizer in fractionation tower 16 is a conventional distillation column containing a plurality of vertically spaced trays, one or more packed beds, or some combination of trays and packing. As shown in FIG. 10, the fractionation tower may consist of two sections. The upper absorbing (rectification) section 16*a* contains the trays and/or packing to provide the necessary contact between the vapors rising upward and cold liquid falling downward to condense and absorb the ethane and heavier components; the lower stripping (demethanizing) section 16*b* contains the trays and/or packing to provide the necessary contact between the liquids falling downward and the vapors rising upward. The demethanizing section also includes one or more reboilers (such as reboiler 22) which heat and vaporize a portion of the liquids flowing down the column to provide the stripping vapors which flow up the column. The liquid product stream 47 exits the bottom of the tower at 71° F. [22° C.], based on a methane to ethane ratio of 0.005:1 on a volume basis in the bottom product. After cooling to 18° F. [−8° C.] in heat exchanger 13 as described previously, the liquid product (stream 47*a*) flows to storage or further processing.

Overhead distillation stream 46 is withdrawn from the upper section of fractionation tower 16 at −146° F. [−99° C.] and flows to reflux condenser 17 where it is cooled to −147° F. [−99° C.] and partially condensed by heat exchange with the cold LNG (stream 41*a*) as described previously. The partially condensed stream 46*a* enters reflux separator 18 wherein the condensed liquid (stream 49) is separated from the uncondensed vapor (stream 48). The liquid stream 49 from reflux separator 18 is pumped by reflux pump 19 to a pressure slightly above the operating pressure of demethanizer 16 and stream 49*a* is then supplied as cold top column feed (reflux) to demethanizer 16. This cold liquid reflux absorbs and condenses the $C_2$ components and heavier hydrocarbon components from the vapors rising in the upper rectification section of demethanizer 16.

The residue gas (stream 48) leaves reflux separator 18 at −147° F. [−99° C.], is heated to −40° F. [−40° C.] in cross exchanger 29 (stream 48*a*), and is compressed by compressor 28 to sales line pressure (stream 48*b*). Following cooling to 43° F. [6° C.] in cross exchanger 29, the residue gas product (stream 48*c*) flows to the sales gas pipeline at 1315 psia [9,067 kPa(a)] for subsequent distribution.

A summary of stream flow rates and energy consumption for the process illustrated in FIG. 10 is set forth in the following table:

TABLE X (FIG. 10) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 3,048 | 313 | 103 | 35 | 3,513 |
| 43 | 6,476 | 664 | 219 | 74 | 7,466 |
| 46 | 17,648 | 8 | 0 | 0 | 17,717 |
| 49 | 8,135 | 7 | 0 | 0 | 8,156 |
| 48 | 9,513 | 1 | 0 | 0 | 9,561 |
| 47 | 11 | 976 | 322 | 109 | 1,418 |

| Recoveries* | | | |
|---|---|---|---|
| Ethane | 99.90% | | |
| Propane | 100.00% | | |
| Butanes+ | 100.00% | | |
| Power | | | |
| LNG Feed Pump | 287 | HP | [472 kW] |
| Reflux Pump | 25 | HP | [41 kW] |
| Residue Gas Compressor | 5,248 | HP | [8,628 kW] |
| Totals | 5,560 | HP | [9,141 kW] |
| Low Level Utility Heat | | | |
| LNG Heater | 32,493 | MBTU/Hr | [20,991 kW] |
| High Level Utility Heat | | | |
| Demethanizer Reboiler | 9,741 | MBTU/Hr | [6,293 kW] |

*(Based on un-rounded flow rates)

Comparing the recovery levels displayed in Table X above for the FIG. 10 process with those in Table I for the FIG. 1 prior art process shows that the present invention can achieve much higher liquids recovery efficiency than the FIG. 1 process. Comparing the utilities consumptions in Table X with those in Table I shows that the power requirement for the present invention is essentially the same as that for the FIG. 1 process, and that the high level utility heat required for the present invention is only slightly higher (about 18%) than that for the FIG. 1 process.

Comparing the recovery levels displayed in Table X with those in Tables IV and VII for the FIGS. 4 and 7 prior art processes shows that the present invention matches the liquids recovery efficiencies of the FIGS. 4 and 7 processes. Comparing the utilities consumptions in Table X with those in Tables IV and VII shows that the power requirement for the present invention is essentially the same as that for the FIGS. 4 and 7 processes, but that the high level utility heat required for the present invention is substantially lower (about 69% lower and 9% lower, respectively) than that for the FIGS. 4 and 7 processes.

There are three primary factors that account for the improved efficiency of the present invention. First, compared to the FIG. 1 prior art process, the present invention does not depend on the LNG feed itself to directly serve as the reflux for fractionation column 16. Rather, the refrigeration inherent in the cold LNG is used indirectly in reflux condenser 17 to generate a liquid reflux stream (stream 49) that contains very little of the $C_2$ components and heavier hydrocarbon components that are to be recovered, resulting in efficient rectification in the upper absorbing section 16*a* of fractionation tower 16 and avoiding the equilibrium limitations of the prior art FIG. 1 process (similar to the steps shown in the FIG. 4 prior art process). Second, compared to the FIG. 4 prior art process, splitting the LNG feed into two portions before feeding fractionation tower 16 allows more efficient use of low level utility heat, thereby reducing the amount of high level utility heat consumed by reboiler 22. The relatively colder portion of the LNG feed (stream 42*a* in FIG. 10) serves as a second reflux stream for fractionation tower 16, providing partial rectification of the vapors in the heated portion (stream 43*c* in FIG. 10) so that heating and vaporizing this portion of the LNG feed does not unduly increase the load on reflux condenser 17. Third, compared to the FIG. 7 prior art process, using the entire LNG feed (stream 41*a* in FIG. 10) in reflux condenser 17 rather than just a portion (stream 42*a* in FIG. 7) allows generating more reflux for fractionation tower 16, as can be seen by comparing stream 49 in Table X with stream 49 in Table VII. The higher reflux flow allows more of the LNG feed to be heated using low level utility heat in heat exchanger 14 (compare stream 43 in Table X with stream 43 in Table VII), reducing the duty required in reboiler 22 and minimizing the amount of high level utility heat needed to meet the specification for the bottom liquid product from the demethanizer.

Example 2

Figure 11:
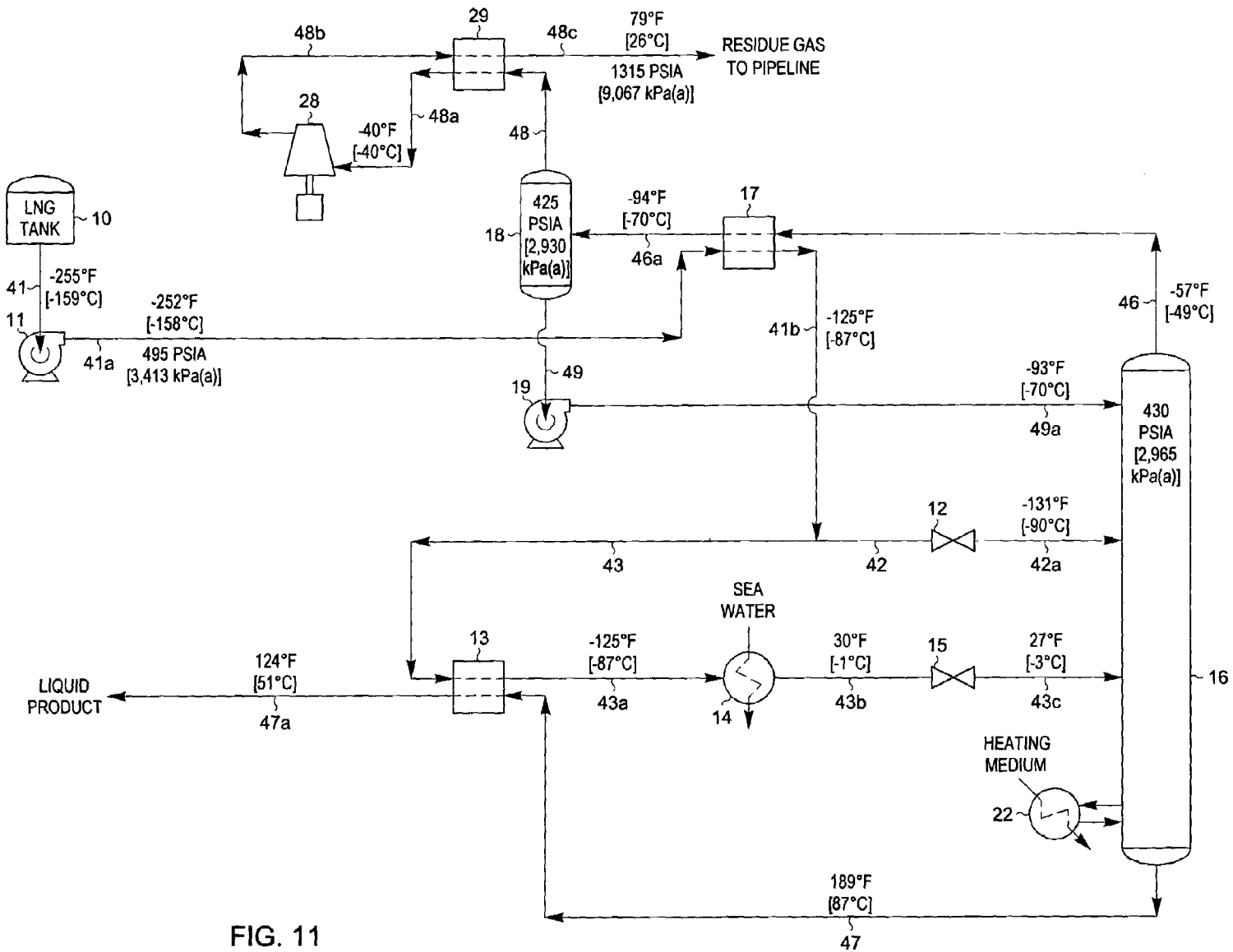
FIGS. 11 through 18 are flow diagrams illustrating alternative means of application of the present invention to an LNG processing plant.

The present invention can also be adapted to produce an LPG product containing the majority of the $C_3$ components and heavier hydrocarbon components present in the feed stream as shown in FIG. 11. The LNG composition and conditions considered in the process presented in FIG. 11 are the same as described previously for FIGS. 2, 5, and 8. Accordingly, the FIG. 11 process of the present invention can be compared to the prior art processes displayed in FIGS. 2, 5, and 8.

The processing scheme for the FIG. 11 process is essentially the same as that used for the FIG. 10 process described previously. The only significant differences are that the heat input of reboiler 22 has been increased to strip the $C_2$ components from the liquid product (stream 47) and the operating pressure of fractionation tower 16 has been raised slightly.

The liquid product stream 47 exits the bottom of deethanizer 16 at 189° F. [87° C.], based on an ethane to propane ratio of 0.020:1 on a molar basis in the bottom product. After cooling to 124° F. [51° C.] in heat exchanger 13, the liquid product (stream 47*a*) flows to storage or further processing. The residue gas (stream 48) leaves reflux separator 18 at −94° F. [−70° C.], is heated to −40° F. [−40° C.] in cross exchanger 29 (stream 48*a*), and is compressed by compressor 28 to sales line pressure (stream 48*b*). Following cooling to 79° F. [26° C.] in cross exchanger 29, the residue gas product (stream 48*c*) flows to the sales gas pipeline at 1315 psia [9,067 kPa(a)] for subsequent distribution.

A summary of stream flow rates and energy consumption for the process illustrated in FIG. 11 is set forth in the following table:

TABLE XI (FIG. 11) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 42 | 3,048 | 313 | 103 | 35 | 3,513 |
| 43 | 6,476 | 664 | 219 | 74 | 7,466 |
| 46 | 12,067 | 3,425 | 4 | 0 | 15,547 |
| 49 | 2,543 | 2,454 | 4 | 0 | 5,005 |
| 48 | 9,524 | 971 | 0 | 0 | 10,542 |
| 47 | 0 | 6 | 322 | 109 | 437 |

| | | |
|---|---|---|
| Recoveries* | | |
| Propane | 99.90% | |
| Butanes+ | 100.00% | |
| Power | | |
| LNG Feed Pump | 309 HP | [508 kW] |
| Reflux Pump | 16 HP | [26 kW] |
| Residue Gas Compressor | 5,106 HP | [8,394 kW] |
| Totals | 5,431 HP | [8,928 kW] |
| Low Level Utility Heat | | |
| LNG Heater | 28,486 MBTU/Hr | [18,402 kW] |
| High Level Utility Heat | | |
| Deethanizer Reboiler | 23,077 MBTU/Hr | [14,908 kW] |

*(Based on un-rounded flow rates)

Comparing the recovery levels displayed in Table XI above for the FIG. 11 process with those in Table II for the FIG. 2 prior art process shows that the present invention can achieve much higher liquids recovery efficiency than the FIG. 2 process. Comparing the utilities consumptions in Table XI with those in Table II shows that the power requirement for the present invention is essentially the same as that for the FIG. 2 process, although the high level utility heat required for the present invention is significantly higher (about 40%) than that for the FIG. 2 process.

Comparing the recovery levels displayed in Table XI with those in Tables V and VIII for the FIGS. 5 and 8 prior art processes shows that the present invention matches the liquids recovery efficiencies of the FIGS. 5 and 8 processes. Comparing the utilities consumptions in Table XI with those in Tables V and VIII shows that the power requirement for the present invention is essentially the same as that for the FIGS. 5 and 8 processes, but that the high level utility heat required for the present invention is substantially lower (about 54% lower and 11% lower, respectively) than that for the FIGS. 5 and 8 processes.

Example 3

Figure 12:
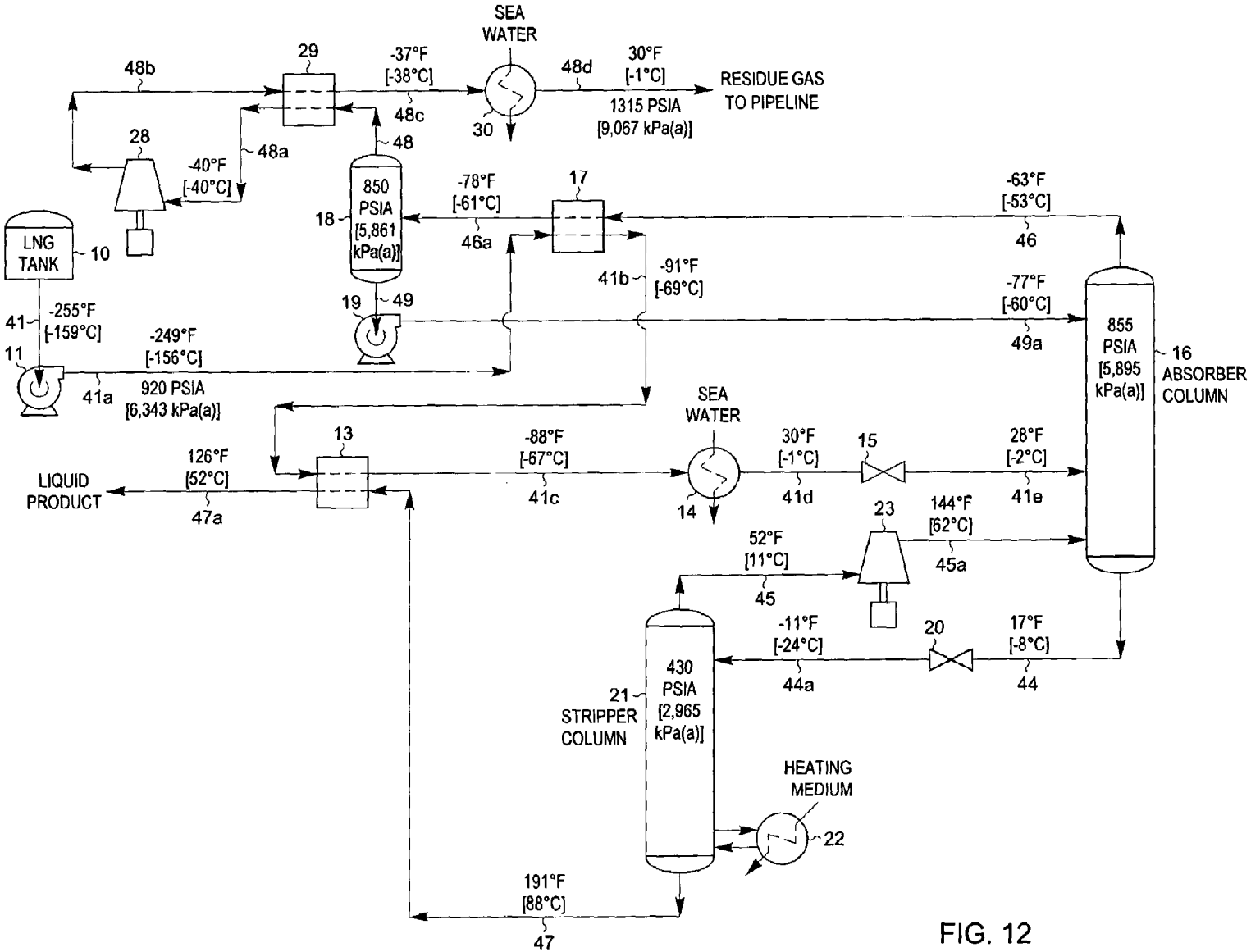

If a slightly lower recovery level is acceptable, another embodiment of the present invention may be employed to produce an LPG product using much less power and high level utility heat. FIG. 12 illustrates such an alternative embodiment. The LNG composition and conditions considered in the process presented in FIG. 12 are the same as those in FIG. 11, as well as those described previously for FIGS. 3, 6, and 9. Accordingly, the FIG. 12 process of the present invention can be compared to the embodiment displayed in FIG. 11 and to the prior art processes displayed in FIGS. 3, 6, and 9.

In the simulation of the FIG. 12 process, the LNG to be processed (stream 41) from LNG tank 10 enters pump 11 at −255° F. [−159° C.]. Pump 11 elevates the pressure of the LNG sufficiently so that it can flow through heat exchangers and thence to absorber column 16. Stream 41*a* exiting the pump is heated first to −91° F. [−69° C.] in reflux condenser 17 as it provides cooling to the overhead vapor (distillation stream 46) withdrawn from contacting device absorber column 16. The partially heated stream 41*b* is then heated to −88° F. [−67° C.] (stream 41*c*) in heat exchanger 13 by cooling the liquid product (stream 47) from fractionation stripper column 21, and then further heated to 30° F. [−1° C.] (stream 41*d*) in heat exchanger 14 using low level utility heat. After expansion to the operating pressure (approximately 855 psia [5,895 kPa(a)]) of absorber column 16 by valve 15, stream 41*e* flows to a lower column feed point on the column at 28° F. [−2° C.]. The liquid portion (if any) of expanded stream 41*e* commingles with liquids falling downward from the upper section of absorber column 16 and the combined liquid stream 44 exits the bottom of contacting device absorber column 16 at 17° F. [−8° C.]. The vapor portion of expanded stream 41*e* rises upward through absorber column 16 and is contacted with cold liquid falling downward to condense and absorb the $C_3$ components and heavier hydrocarbon components.

The combined liquid stream 44 from the bottom of the absorber column 16 is flash expanded to slightly above the operating pressure (430 psia [2,965 kPa(a)]) of stripper column 21 by expansion valve 20, cooling stream 44 to −11° F. [−24° C.] (stream 44*a*) before it enters fractionation stripper column 21 at a top column feed point. In the stripper column 21, stream 44*a* is stripped of its methane and $C_2$ components by the vapors generated in reboiler 22 to meet the specification of an ethane to propane ratio of 0.020:1 on a molar basis. The resulting liquid product stream 47 exits the bottom of stripper column 21 at 191° F. [88° C.] and is cooled to 126° F. [52° C.] in heat exchanger 13 (stream 47*a*) before flowing to storage or further processing.

The overhead vapor (stream 45) from stripper column 21 exits the column at 52° F. [11° C.] and enters overhead compressor 23 (driven by a supplemental power source). Overhead compressor 23 elevates the pressure of stream 45*a* to slightly above the operating pressure of absorber column 16 so that stream 45*a* can be supplied to absorber column 16 at a lower column feed point. Stream 45*a* enters absorber column 16 at 144° F. [62° C.], whereupon it rises upward through absorber column 16 and is contacted with cold liquid falling downward to condense and absorb the $C_3$ components and heavier hydrocarbon components.

Overhead distillation stream 46 is withdrawn from contacting device absorber column 16 at −63° F. [−53° C.] and flows to reflux condenser 17 where it is cooled to −78° F. [−61° C.] and partially condensed by heat exchange with the cold LNG (stream 41*a*) as described previously. The partially condensed stream 46*a* enters reflux separator 18 wherein the condensed liquid (stream 49) is separated from the uncondensed vapor (stream 48). The liquid stream 49 from reflux separator 18 is pumped by reflux pump 19 to a pressure slightly above the operating pressure of absorber column 16 and stream 49*a* is then supplied as cold top column feed (reflux) to absorber column 16. This cold liquid reflux absorbs and condenses the $C_3$ components and heavier hydrocarbon components from the vapors rising in absorber column 16.

The residue gas (stream 48) leaves reflux separator 18 at −78° F. [−61° C.], is heated to −40° F. [−40° C.] in cross exchanger 29 (stream 48*a*), and is compressed by compressor 28 to sales line pressure (stream 48*b*). Following cooling to −37° F. [−38° C.] in cross exchanger 29, stream 48*c* is heated to 30° F. [−1° C.] using low level utility heat in heat exchanger 30 and the residue gas product (stream 48*d*) flows to the sales gas pipeline at 1315 psia [9,067 kPa(a)] for subsequent distribution.

A summary of stream flow rates and energy consumption for the process illustrated in FIG. 12 is set forth in the following table:

TABLE XII (FIG. 12) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 44 | 705 | 447 | 552 | 129 | 1,835 |
| 45 | 705 | 441 | 246 | 20 | 1,414 |
| 46 | 31,114 | 4,347 | 93 | 0 | 35,687 |
| 49 | 21,590 | 3,376 | 77 | 0 | 25,129 |
| 48 | 9,524 | 971 | 16 | 0 | 10,558 |
| 47 | 0 | 6 | 306 | 109 | 421 |

| | | |
|---|---|---|
| Recoveries* | | |
| Propane | 95.01% | |
| Butanes+ | 99.98% | |
| Power | | |
| LNG Feed Pump | 616 HP | [1,013 kW] |
| Reflux Pump | 117 HP | [192 kW] |
| Overhead Compressor | 422 HP | [694 kW] |
| Residue Gas Compressor | 1,424 HP | [2,341 kW] |
| Totals | 2,579 HP | [4,240 kW] |
| Low Level Utility Heat | | |
| LNG Heater | 32,436 MBTU/Hr | [20,954 kW] |
| Residue Gas Heater | 12,541 MBTU/Hr | [8,101 kW] |
| Totals | 44,977 MBTU/Hr | [29,055 kW] |
| High Level Utility Heat | | |
| Deethanizer Reboiler | 7,336 MBTU/Hr | [4,739 kW] |

*(Based on un-rounded flow rates)

Comparing Table XII above for the FIG. 12 embodiment of the present invention with Table XI for the FIG. 11 embodiment of the present invention shows that there is a reduction in liquids recovery (from 99.90% propane recovery and 100.00% butanes+recovery to 95.01% propane recovery and 99.98% butanes+recovery) for the FIG. 12 embodiment. However, the power and heat requirements for the FIG. 12 embodiment are less than one-half of those for the FIG. 11 embodiment. The choice of which embodiment to use for a particular application will generally be dictated by the monetary value of the heavier hydrocarbons in the LPG product versus their corresponding value as gaseous fuel in the residue gas product, and by the cost of power and high level utility heat.

Comparing the recovery levels displayed in Table XII with those in Tables III, VI, and IX for the FIGS. 3, 6, and 9 prior art processes shows that the present invention matches the liquids recovery efficiencies of the FIGS. 3, 6, and 9 processes. Comparing the utilities consumptions in Table XII with those in Tables III, VI, and IX shows that the power requirement for this embodiment of the present invention is significantly less (about 52% lower) than that for the FIGS. 3, 6, and 9 processes, as is the high level utility heat required (about 38%, 83%, and 57% lower, respectively, than that for the FIGS. 3, 6, and 9 processes).

Comparing this embodiment of the present invention to the prior art process displayed in FIGS. 3, 6, and 9, note that while the operating pressure of fractionation stripper column 21 is the same as that of fractionation tower 16 in the three prior art processes, the operating pressure of contacting device absorber column 16 is significantly higher, 855 psia [5,895 kPa(a)] versus 430 psia [2,965 kPa(a)]. Accordingly, the residue gas enters compressor 28 at a higher pressure in the FIG. 12 embodiment of the present invention and less compression horsepower is therefore needed to deliver the residue gas to pipeline pressure.

Since the prior art processes perform rectification and stripping in the same tower (i.e., absorbing section 16*a* and stripping section 16*b* contained in fractionation tower 16 in FIG. 1), the two operations must of necessity be performed at essentially the same pressure in the prior art processes. The power consumption of the prior art processes could be reduced by raising the operating pressure of deethanizer 16. Unfortunately, this is not advisable in this instance because of the detrimental effect on distillation performance in deethanizer 16 that would result from the higher operating pressure. This effect is manifested by poor mass transfer in deethanizer 16 due to the phase behavior of its vapor and liquid streams. Of particular concern are the physical properties that affect the vapor-liquid separation efficiency, namely the liquid surface tension and the differential in the densities of the two phases. As a result, the operating pressure of deethanizer 16 should not be raised above the values shown in FIGS. 3, 6, and 9, so there is no means available to reduce the power consumption of compressor 28 using the prior art process.

With overhead compressor 23 supplying the motive force to cause the overhead from stripper column 21 (stream 45 in FIG. 12) to flow to absorber column 16, the operating pressures of the rectification operation (absorber column 16) and the stripping operation (stripper column 21) are no longer coupled together as they are in the prior art processes. Instead, the operating pressures of the two columns can be optimized independently. In the case of stripper column 21, the pressure can be selected to insure good distillation characteristics, while for absorber column 16 the pressure can be selected to optimize the liquids recovery level versus the residue gas compression power requirements.

The dramatic reduction in the duty of reboiler 22 for the FIG. 12 embodiment of the present invention is the result of two factors. First, as liquid stream 44 from the bottom of absorber column 16 is flash expanded to the operating pressure of stripper column 21, a significant portion of the methane and $C_2$ components in this stream is vaporized. These vapors return to absorber column 16 in stream 45*a* to serve as stripping vapors for the liquids flowing downward in the absorber column, so that there is less of the methane and $C_2$ components to be stripped from the liquids in stripper column 21. Second, overhead compressor 23 is in essence a heat pump serving as a side reboiler to absorber column 16, since the heat of compression is supplied directly to the bottom of absorber column 16. This further reduces the amount of methane and $C_2$ components contained in stream 44 that must be stripped from the liquids in stripper column 21.

Example 4

Figure 13:
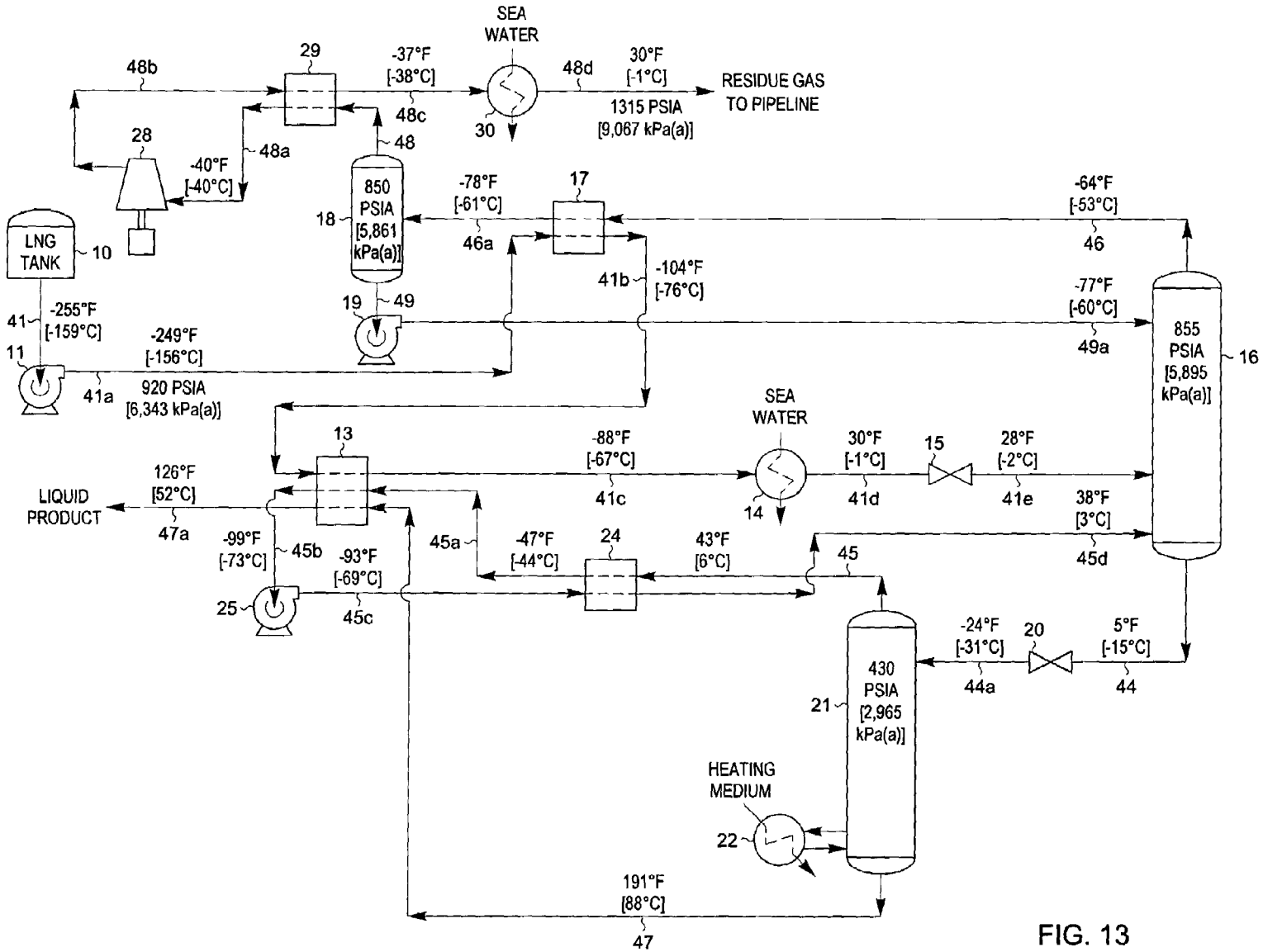

A slightly more complex design that maintains the same $C_3$ component recovery with lower power consumption can be achieved using another embodiment of the present invention as illustrated in the FIG. 13 process. The LNG composition and conditions considered in the process presented in FIG. 13 are the same as those in FIG. 12. Accordingly, the FIG. 13 embodiment can be compared to the embodiment displayed in FIG. 12.

In the simulation of the FIG. 13 process, the LNG to be processed (stream 41) from LNG tank 10 enters pump 11 at −255° F. [−159° C.]. Pump 11 elevates the pressure of the LNG sufficiently so that it can flow through heat exchangers and thence to absorber column 16. Stream 41*a* exiting the pump is heated first to −104° F. [−76° C.] in reflux condenser 17 as it provides cooling to the overhead vapor (distillation stream 46) withdrawn from contacting device absorber column 16. The partially heated stream 41*b* is then heated to −88° F. [−67° C.] (stream 41*c*) in heat exchanger 13 by cooling the overhead stream (stream 45*a*) and the liquid product (stream 47) from fractionation stripper column 21, and then further heated to 30° F. [−1° C.] (stream 41*d*) in heat exchanger 14 using low level utility heat. After expansion to the operating pressure (approximately 855 psia [5,895 kPa(a)]) of absorber column 16 by valve 15, stream 41*e* flows to a lower column feed point on absorber column 16 at 28° F. [−2° C.]. The liquid portion (if any) of expanded stream 41*e* commingles with liquids falling downward from the upper section of absorber column 16 and the combined liquid stream 44 exits the bottom of absorber column 16 at 5° F. [−15° C.]. The vapor portion of expanded stream 41*e* rises upward through absorber column 16 and is contacted with cold liquid falling downward to condense and absorb the $C_3$ components and heavier hydrocarbon components.

The combined liquid stream 44 from the bottom of contacting device absorber column 16 is flash expanded to slightly above the operating pressure (430 psia [2,965 kPa (a)]) of stripper column 21 by expansion valve 20, cooling stream 44 to −24° F. [−31° C.] (stream 44*a*) before it enters fractionation stripper column 21 at a top column feed point. In the stripper column 21, stream 44*a* is stripped of its methane and $C_2$ components by the vapors generated in reboiler 22 to meet the specification of an ethane to propane ratio of 0.020:1 on a molar basis. The resulting liquid product stream 47 exits the bottom of stripper column 21 at 191° F. [88° C.] and is cooled to 126° F. [52° C.] in heat exchanger 13 (stream 47*a*) before flowing to storage or further processing.

The overhead vapor (stream 45) from stripper column 21 exits the column at 43° F. [6° C.] and flows to cross exchanger 24 where it is cooled to −47° F. [−44° C.] and partially condensed. Partially condensed stream 45*a* is further cooled to −99° F. [−73° C.] in heat exchanger 13 as previously described, condensing the remainder of the stream. Condensed liquid stream 45*b* then enters overhead pump 25, which elevates the pressure of stream 45*c* to slightly above the operating pressure of absorber column 16. Stream 45*c* returns to cross exchanger 24 and is heated to 38° F. [3° C.] and partially vaporized as it provides cooling to stream 45. Partially vaporized stream 45*d* is then supplied to absorber column 16 at a lower column feed point, whereupon its vapor portion rises upward through absorber column 16 and is contacted with cold liquid falling downward to condense and absorb the $C_3$ components and heavier hydrocarbon components. The liquid portion of stream 45*d* commingles with liquids falling downward from the upper section of absorber column 16 and becomes part of combined liquid stream 44 leaving the bottom of absorber column 16.

Overhead distillation stream 46 is withdrawn from contacting device absorber column 16 at −64° F. [−53° C.] and flows to reflux condenser 17 where it is cooled to −78° F. [−61° C.] and partially condensed by heat exchange with the cold LNG (stream 41*a*) as described previously. The partially condensed stream 46*a* enters reflux separator 18 wherein the condensed liquid (stream 49) is separated from the uncondensed vapor (stream 48). The liquid stream 49 from reflux separator 18 is pumped by reflux pump 19 to a pressure slightly above the operating pressure of absorber column 16 and stream 49*a* is then supplied as cold top column feed (reflux) to absorber column 16. This cold liquid reflux absorbs and condenses the $C_3$ components and heavier hydrocarbon components from the vapors rising in absorber column 16.

The residue gas (stream 48) leaves reflux separator 18 at −78° F. [−61° C.], is heated to −40° F. [−40° C.] in cross exchanger 29 (stream 48*a*), and is compressed by compressor 28 to sales line pressure (stream 48*b*). Following cooling to −37° F. [−38° C.] in cross exchanger 29, stream 48*c* is heated to 30° F. [−1° C.] using low level utility heat in heat exchanger 30 and the residue gas product (stream 48*d*) flows to the sales gas pipeline at 1315 psia [9,067 kPa(a)] for subsequent distribution.

A summary of stream flow rates and energy consumption for the process illustrated in FIG. 13 is set forth in the following table:

TABLE XIII (FIG. 13) Stream Flow Summary - Lb. Moles/Hr [kg moles/Hr]

| Stream | Methane | Ethane | Propane | Butanes+ | Total |
|---|---|---|---|---|---|
| 41 | 9,524 | 977 | 322 | 109 | 10,979 |
| 44 | 850 | 534 | 545 | 127 | 2,058 |
| 45 | 850 | 528 | 239 | 18 | 1,637 |
| 46 | 28,574 | 3,952 | 83 | 0 | 32,732 |
| 49 | 19,050 | 2,981 | 67 | 0 | 22,174 |
| 48 | 9,524 | 971 | 16 | 0 | 10,558 |
| 47 | 0 | 6 | 306 | 109 | 421 |

| | | |
|---|---|---|
| Recoveries* | | |
| Propane | 95.05% | |
| Butanes+ | 99.98% | |
| Power | | |
| LNG Feed Pump | 616 HP | [1,013 kW] |
| Reflux Pump | 103 HP | [169 kW] |
| Overhead Pump | 74 HP | [122 kW] |
| Residue Gas Compressor | 1,424 HP | [2,341 kW] |
| Totals | 2,217 HP | [3,645 kW] |
| Low Level Utility Heat | | |
| LNG Heater | 32,453 MBTU/Hr | [20,965 kW] |

TABLE XIII-continued

| (FIG. 13) Stream Flow Summary - Lb. Moles/Hr [kg moles/Hr] | | |
|---|---|---|
| Residue Gas Heater | 12,535 MBTU/Hr | [8,098 kW] |
| Totals | 44,988 MBTU/Hr | [29,063 kW] |
| High Level Utility Heat | | |
| Deethanizer Reboiler | 8,218 MBTU/Hr | [5,309 kW] |

*(Based on un-rounded flow rates)

Comparing Table XIII above for the FIG. 13 embodiment of the present invention with Table XII for the FIG. 12 embodiment of the present invention shows that the liquids recovery is the same for the FIG. 13 embodiment. Since the FIG. 13 embodiment uses a pump (overhead pump 25 in FIG. 13) rather than a compressor (overhead compressor 23 in FIG. 12) to route the overhead vapor from fractionation stripper column 21 to contacting device absorber column 16, less power is required by the FIG. 13 embodiment. However, since the resulting stream 45*d* supplied to absorber column 16 is not fully vaporized, more liquid leaves absorber column 16 in bottoms stream 44 and must be stripped of its methane and $C_2$ components in stripper column 21, increasing the load on reboiler 22 and increasing the amount of high level utility heat required by the FIG. 13 embodiment of the present invention compared to the FIG. 12 embodiment. The choice of which embodiment to use for a particular application will generally be dictated by the relative costs of power versus high level utility heat and the relative capital costs of pumps and heat exchangers versus compressors.

OTHER EMBODIMENTS

In the FIG. 13 embodiment of the present invention, the partially heated LNG leaving reflux condenser 17 (stream 41*b*) supplies the final cooling to the overhead vapor (stream 45*a*) from fractionation stripper column 21. In some instances, there may not be sufficient cooling available in stream 41*b* to totally condense the overhead vapor. In this circumstance, an alternative embodiment of the present invention such as that shown in FIG. 14 could be employed. Heated liquefied natural gas stream 41*e* is directed into contacting device absorber column 16 wherein distillation stream 46 and liquid stream 44 are formed and separated. Liquid stream 44 is directed into fractionation stripper column 21 wherein the stream is separated into vapor stream 45 and liquid product stream 47. Vapor stream 45 is cooled sufficiently to partially condense it in cross exchanger 24 and heat exchanger 13. An overhead separator 26 can be used to separate the partially condensed overhead stream 45*b* into its respective vapor fraction (stream 50) and liquid fraction (stream 51). Liquid stream 51 enters overhead pump 25 and is pumped through cross exchanger 24 to heat it and partially vaporize it (stream 51*b*). Vapor stream 50 is compressed by overhead compressor 23 (with optional heating before and/or cooling after compression via heat exchangers 31 and/or 32) to raise its pressure so that it can be combined with the outlet from cross exchanger 24 to form combined stream 45*c* that is thereafter supplied to absorber column 16 at a lower column feed point. Alternatively, as shown by the dashed line, some or all of the compressed vapor (stream 50*c*) may be supplied separately to absorber column 16 at a second lower column feed point. Some applications may favor heating the vapor prior to compression (as shown by dashed heat exchanger 31) to allow less expensive metallurgy in compressor 23 or for other reasons. Cooling the outlet from overhead compressor 23 (stream 50*b*), such as in dashed heat exchanger 32, may also be favored under some circumstances.

Figure 15:
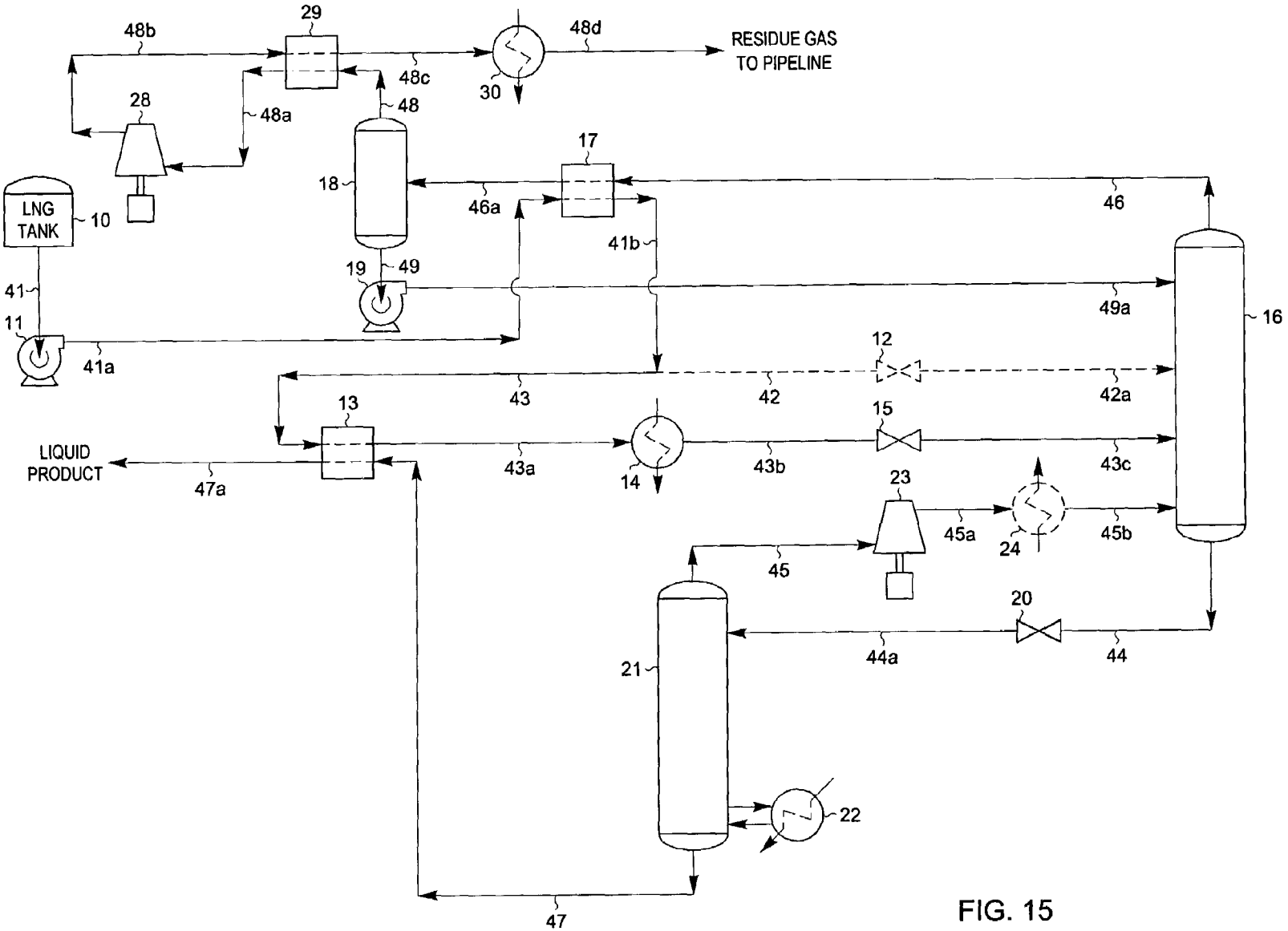
Figure 16:
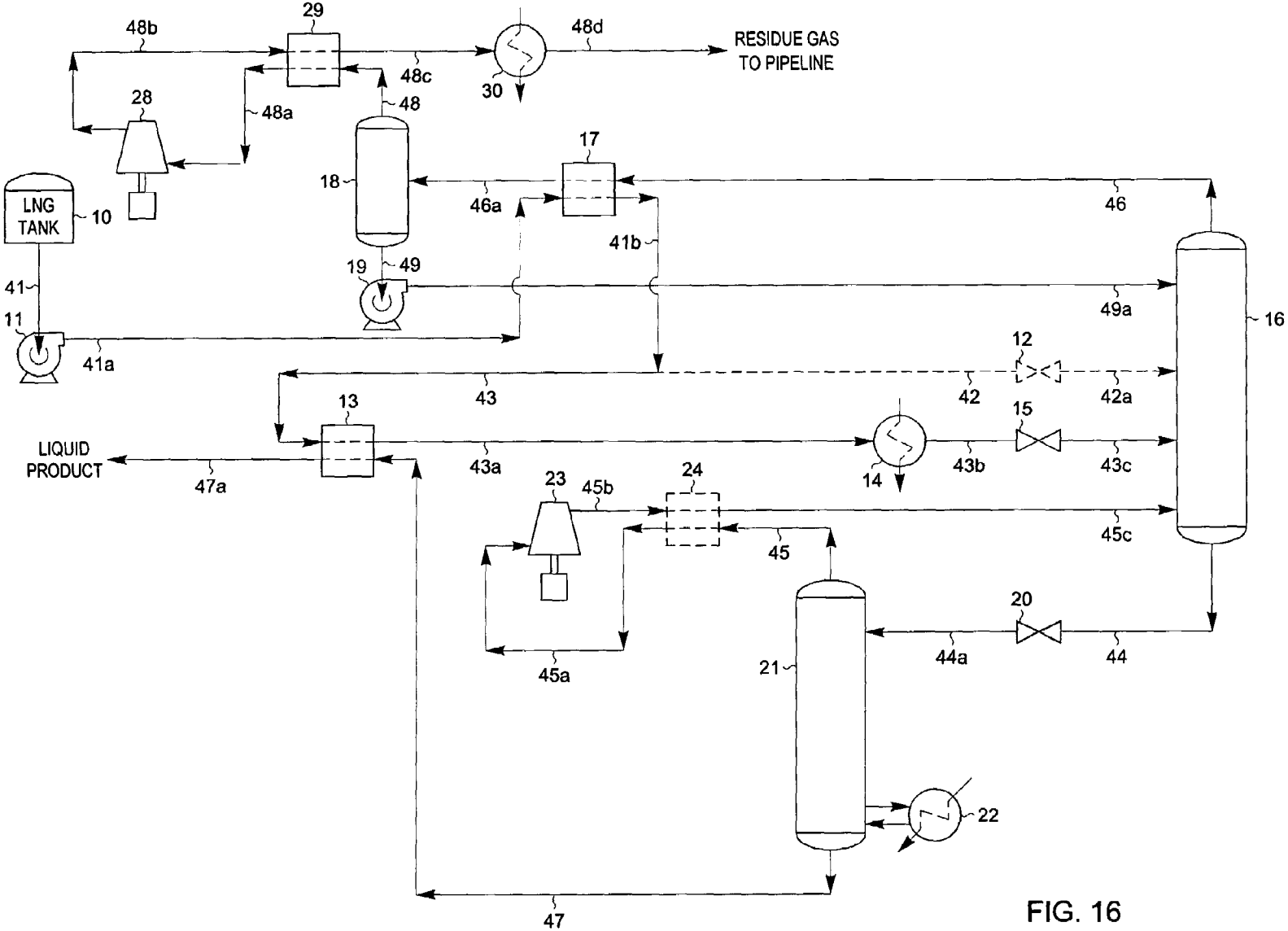

Some circumstances may favor cooling the high pressure stream leaving overhead compressor 23, such as with dashed heat exchanger 24 in FIG. 15. It may also be desirable to heat the overhead vapor before it enters the compressor (to allow less expensive metallurgy in the compressor, for instance), such as with dashed cross exchanger 24 in FIG. 16. The choice of whether to heat the inlet to the overhead compressor and/or cool the outlet from the overhead compressor will depend on the composition of the LNG, the desired liquid recovery level, the operating pressures of absorber column 16 and stripper column 21 and the resulting process temperatures, and other factors.

Some circumstances may favor using a split feed configuration for the LNG feed (as disclosed previously in FIGS. 10 and 11) when using the two column embodiments of the present invention. As shown in FIGS. 15 through 18, the partially heated LNG (stream 41*b* in FIGS. 15 and 16 and stream 41*c* in FIGS. 17 and 18) can be divided into two portions, streams 42 and 43, with the first portion in stream 42 supplied to contacting device absorber column 16 at an upper mid-column feed point without any further heating. After further heating, the second portion in stream 43 can then be supplied to absorber column 16 at a lower mid-column feed point, so that the cold liquids present in the first portion can provide partial rectification of the vapors in the second portion. The choice of whether to use the split feed configuration for the two column embodiments of the present invention will generally depend on the composition of the LNG and the desired liquid recovery level.

Figure 17:
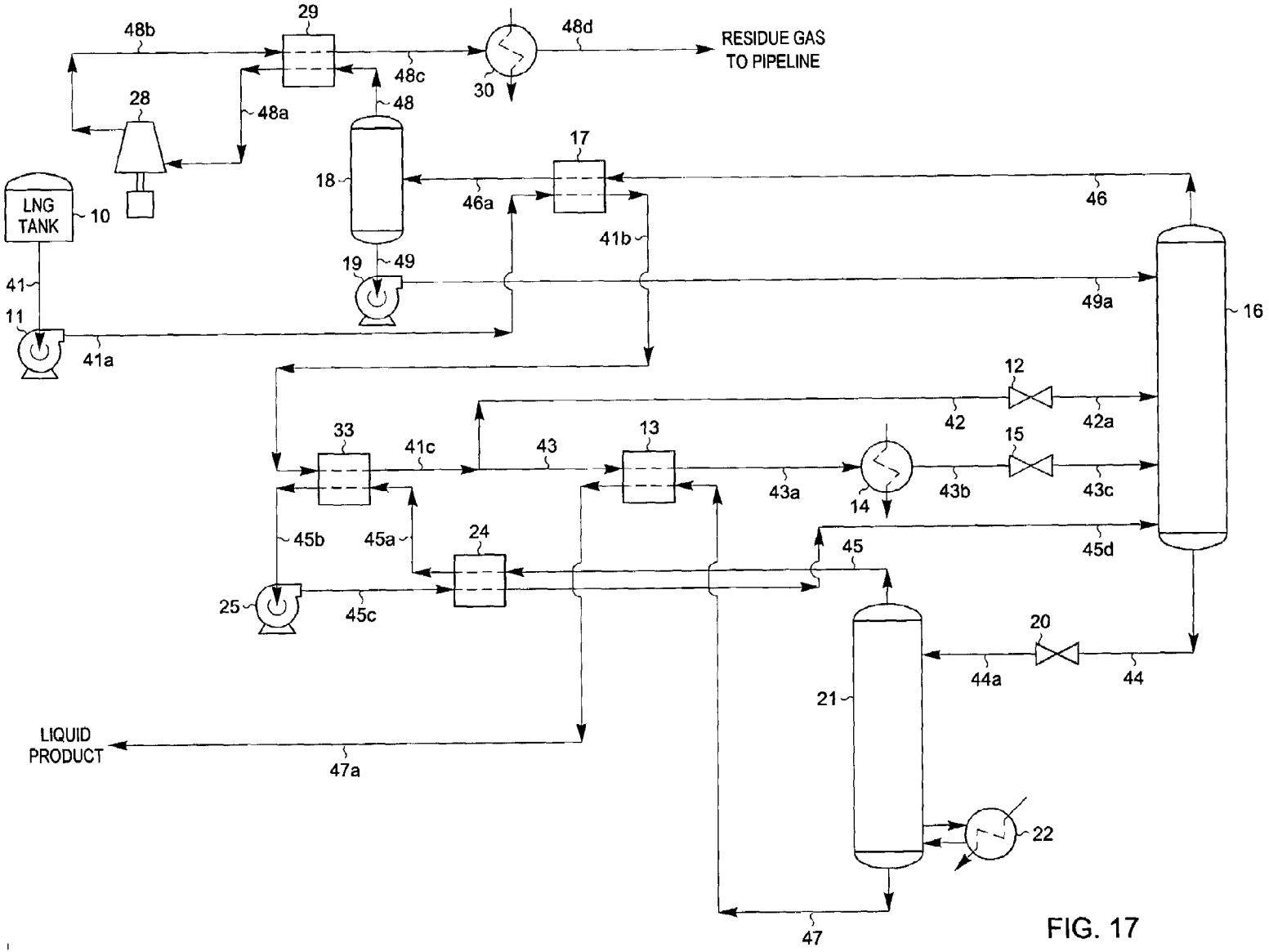

In the FIG. 17 embodiment using a split feed configuration for the LNG feed, liquid stream 44 is directed into fractionation stripper column 21 wherein the stream is separated into vapor stream 45 and liquid product stream 47. The vapor stream is cooled in cross exchanger 24 and heat exchanger 33 to substantial condensation. The substantially condensed stream 45*b* is pumped to higher pressure by pump 25, heated in cross exchanger 24 to vaporize at least a portion of it, and thereafter supplied as stream 45*d* to contacting device absorber column 16 at a lower column feed point.

Figure 18:
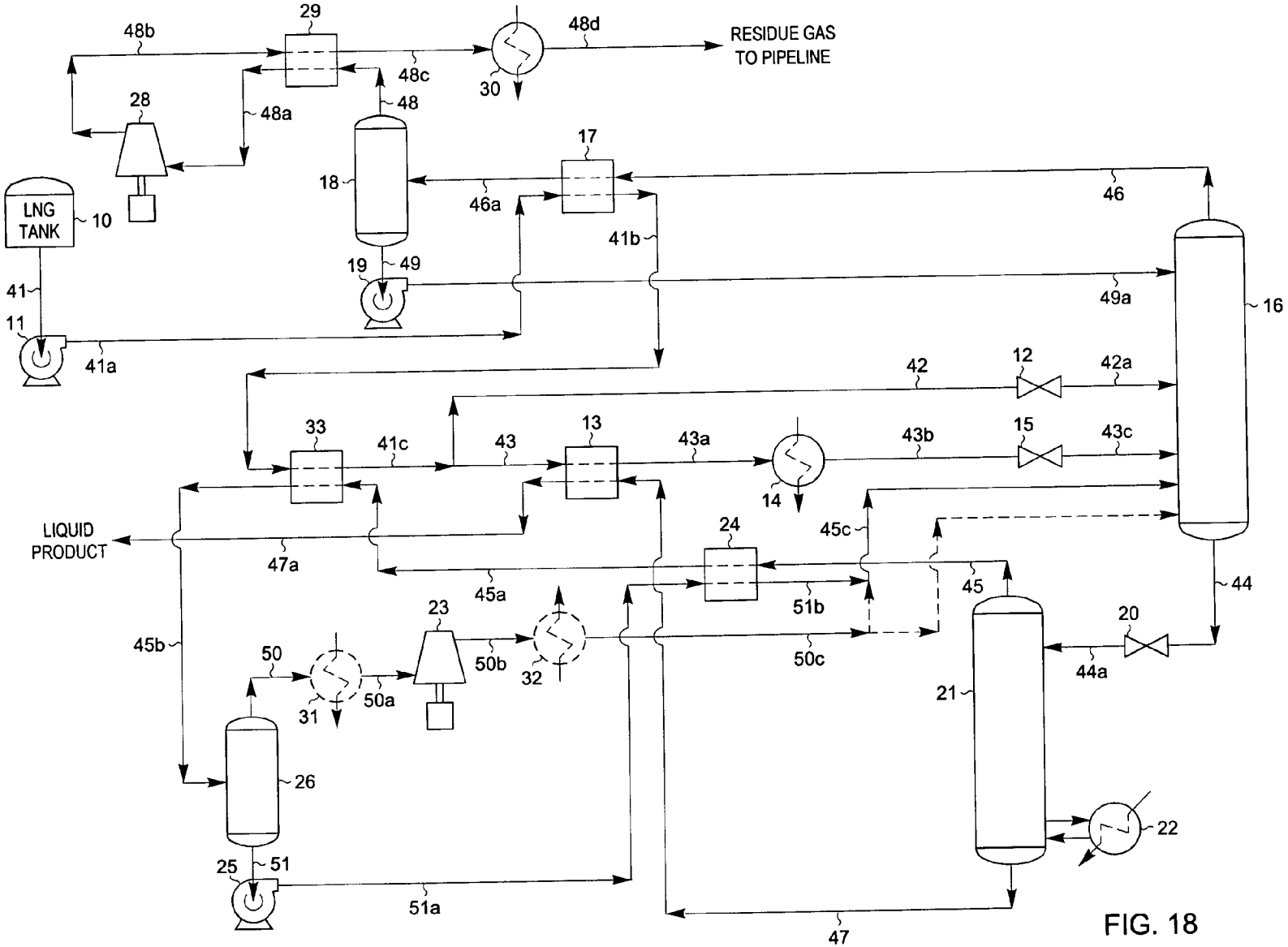

In the FIG. 18 embodiment using a split feed configuration for the LNG feed, vapor stream 45 is cooled in cross exchanger 24 and heat exchanger 33 sufficiently to partially condense it and is thereafter separated in overhead separator 26 into its respective vapor fraction (stream 50) and liquid fraction (stream 51). Liquid stream 51 enters overhead pump 25 and is pumped through cross exchanger 24 to heat it and partially vaporize it (stream 51*b*). Vapor stream 50 is compressed by overhead compressor 23 (with optional heating before and/or cooling after compression via heat exchangers 31 and/or 32) to raise its pressure so that it can be combined with the outlet from cross exchanger 24 to form combined stream 45*c* that is thereafter supplied to absorber column 16 at a lower column feed point. Alternatively, as shown by the dashed line, some or all of the compressed vapor (stream 50*c*) may be supplied separately to absorber column 16 at a second lower column feed point. Some applications may favor heating the vapor prior to compression (as shown by dashed heat exchanger 31) to allow less expensive metallurgy in overhead compressor 23 or for other reasons. Cooling the outlet from overhead compressor 23 (stream 50*b*), such as in dashed heat exchanger 32, may also be favored under some circumstances.

Figure 19:
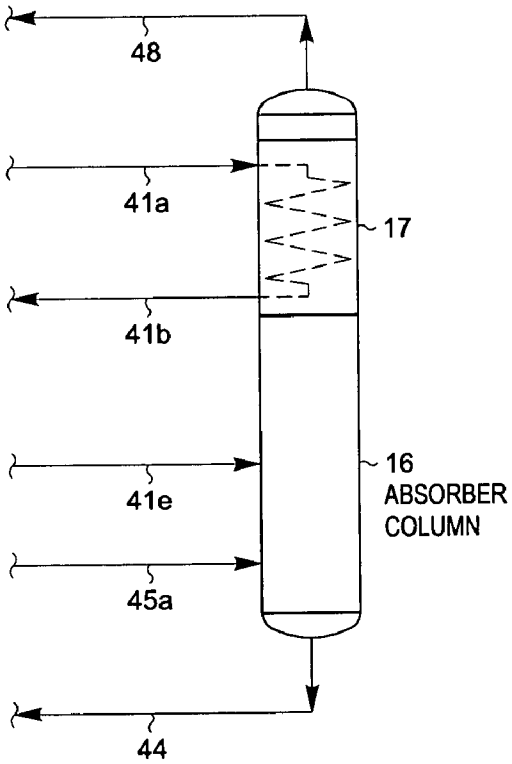
FIGS. 19 and 20 are diagrams of alternative fractionation systems which may be employed in the process of the present invention.
Figure 19:
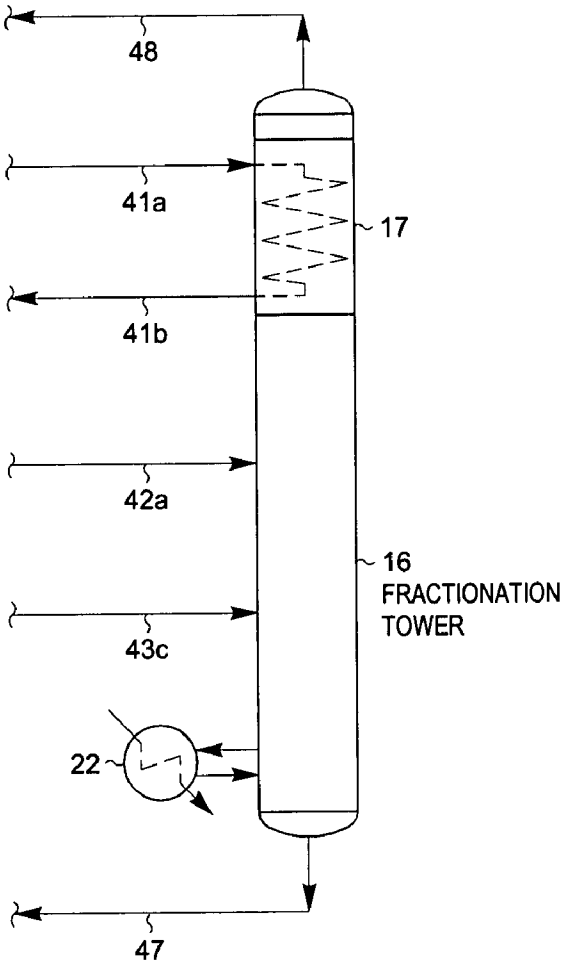
Figure 20:
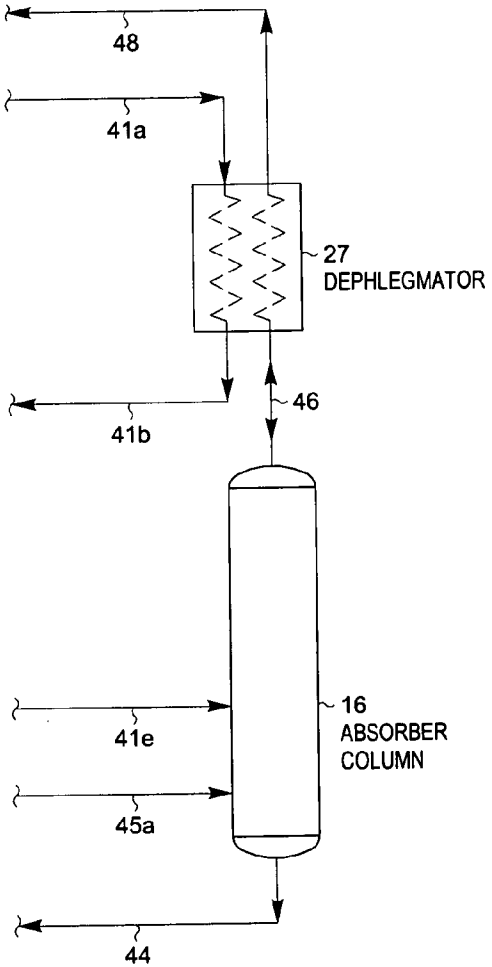
Figure 20:
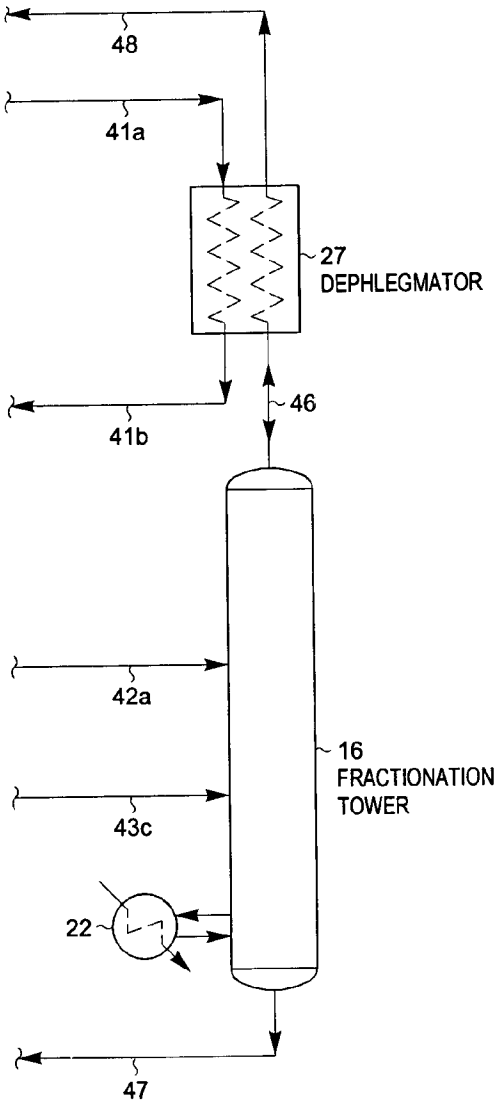

Reflux condenser 17 may be located inside the tower above the rectification section of fractionation tower 16 or absorber column 16 as shown in FIG. 19. This eliminates the need for reflux separator 18 and reflux pump 19 shown in FIGS. 10 through 18 because the distillation stream is then both cooled and separated in the tower above the fractionation stages of the column. Alternatively, use of a dephlegmator (such as dephlegmator 27 in FIG. 20) in place of reflux condenser 17 in FIGS. 10 through 18 eliminates the need for reflux separator 18 and reflux pump 19 and also provides concurrent fractionation stages to supplement those in the upper section of the column. If the dephlegmator is positioned in a plant at grade level, it can be connected to a vapor/liquid separator and the liquid collected in the separator pumped to the top of the distillation column (either fractionation tower 16 or contacting device absorber column 16). The decision as to whether to include the reflux condenser inside the column or to use a dephlegmator usually depends on plant size and heat exchanger surface requirements.

Figure 14:
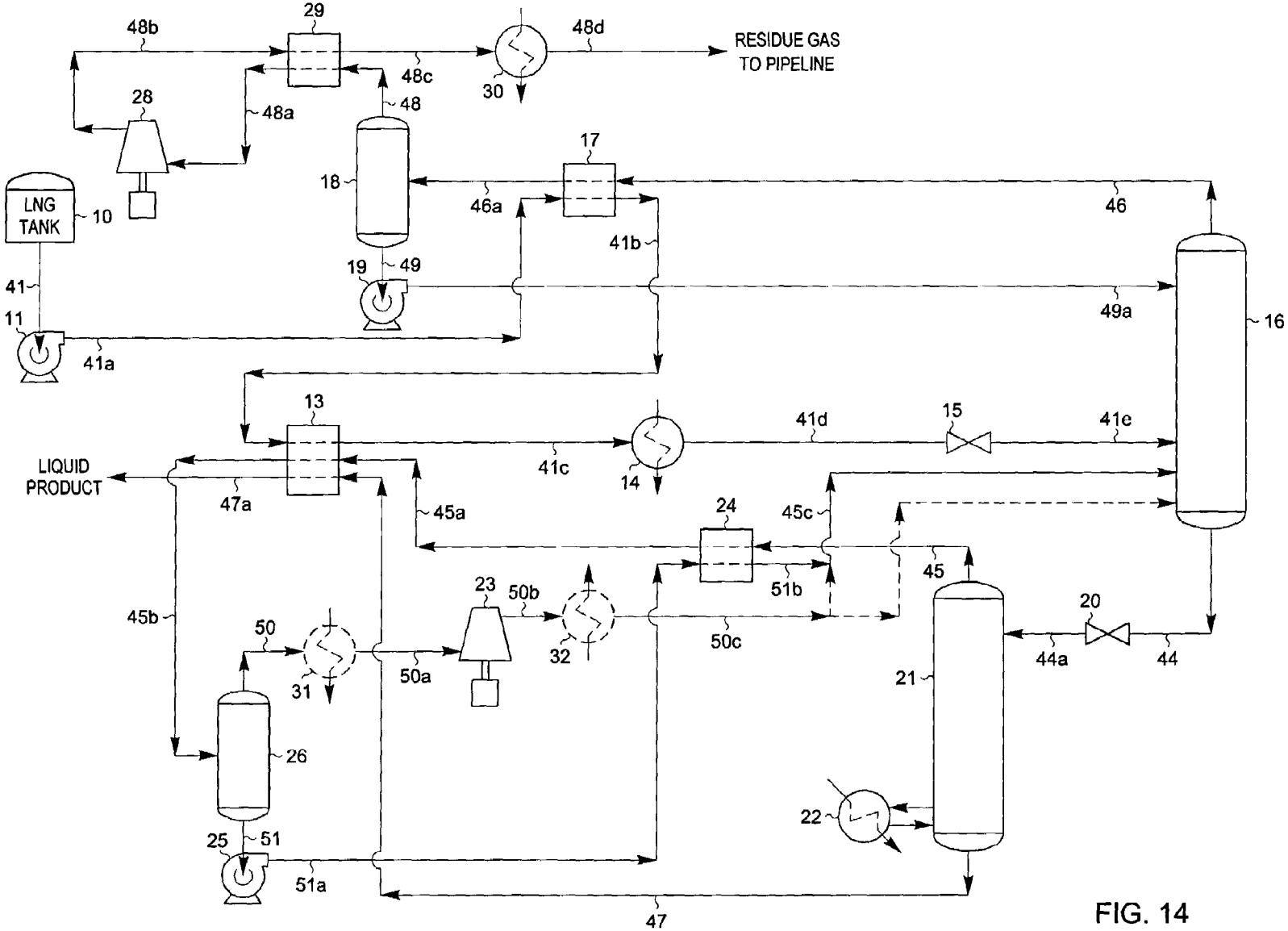

It also should be noted that valves 12 and/or 15 could be replaced with expansion engines (turboexpanders) whereby work could be extracted from the pressure reduction of stream 42 in FIGS. 10, 11, and 15 through 18, stream 43*b* in FIGS. 10, 11, and 15 through 18, and/or stream 41*d* in FIGS. 12 through 14. In this case, the LNG (stream 41) must be pumped to a higher pressure so that work extraction is feasible. This work could be used to provide power for pumping the LNG stream, for compression of the residue gas or the stripper column overhead vapor, or to generate electricity. The choice between use of valves or expansion engines will depend on the particular circumstances of each LNG processing project.

In FIGS. 10–20, individual heat exchangers have been shown for most services. However, it is possible to combine two or more heat exchange services into a common heat exchanger, such as combining heat exchangers 13, 14, and 24 in FIG. 14 into a common heat exchanger. In some cases, circumstances may favor splitting a heat exchange service into multiple exchangers. The decision as to whether to combine heat exchange services or to use more than one heat exchanger for the indicated service will depend on a number of factors including, but not limited to, LNG flow rate, heat exchanger size, stream temperatures, etc.

It will be recognized that the relative amount of feed found in each branch of the split LNG feed to fractionation tower 16 or absorber column 16 will depend on several factors, including LNG composition, the amount of heat which can economically be extracted from the feed, residue gas delivery pressure, and the quantity of horsepower available. More feed to the top of the column may increase recovery while increasing the duty in reboiler 22 and thereby increasing the high level utility heat requirements. Increasing feed lower in the column reduces the high level utility heat consumption but may also reduce product recovery. The relative locations of the mid-column feeds may vary depending on LNG composition or other factors such as the desired recovery level and the amount of vapor formed during heating of the feed streams. Moreover, two or more of the feed streams, or portions thereof, may be combined depending on the relative temperatures and quantities of individual streams, and the combined stream then fed to a mid-column feed position.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of liquefied natural gas containing methane and heavier hydrocarbon components, in which process (a) said liquefied natural gas stream is supplied to a fractionation column in one or more feed streams; and (b) said liquefied natural gas is fractionated into a more volatile fraction containing a major portion of said methane and a relatively less volatile fraction containing a major portion of said heavier hydrocarbon components;

the improvement wherein (1) a distillation stream is withdrawn from an upper region of said fractionation column, is cooled sufficiently to partially condense it, and is thereafter separated to form said more volatile fraction containing a major portion of said methane and a reflux stream;

(2) said reflux stream is supplied to said fractionation column at a top column feed position;

(3) said liquefied natural gas stream is heated to supply at least a portion of said cooling of said distillation stream and thereafter divided into at least a first stream and a second stream;

(4) said first stream is supplied to said fractionation column at an upper mid-column feed position;

(5) said second stream is heated sufficiently to vaporize at least a portion of it and thereafter supplied to said fractionation column at a lower mid-colunm feed position; and (6) the quantity and temperature of said reflux stream and the temperatures of said feeds to said fractionation column are effective to maintain the overhead temperature of said fractionation colunm at a temperature whereby the major portion of said heavier hydrocarbon components is recovered in said relatively less volatile fraction.

2. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated sufficiently to vaporize at least a portion of it, supplying thereby at least a portion of said cooling of said distillation stream;

(5) said heated liquefied natural gas stream is directed into said contacting device, wherein said distillation stream and a liquid stream are formed and separated;

(6) said liquid stream is directed into a fractionation column operating at a pressure lower than the pressure of said contacting device wherein said stream is further fractionated by separating it into a vapor stream and said relatively less volatile fraction containing a major portion of said heavier hydrocarbon components;

(7) said vapor stream is compressed to higher pressure and thereafter supplied to said contacting device at a lower column feed point; and (8) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

3. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated to supply at least a portion of said cooling of said distillation stream and thereafter divided into at least a first stream and a second stream;

(5) said first stream is supplied to said contacting device at a mid-column feed position;

(6) said second stream is heated sufficiently to vaporize at least a portion of it and thereafter supplied to said contacting device at a lower column feed point, wherein said distillation stream and a liquid stream are formed and separated;

(7) said liquid stream is directed into a fractionation column operating at a pressure lower than the pressure of said contacting device wherein said stream is further fractionated by separating it into a vapor stream and said relatively less volatile fraction containing a major portion of said heavier hydrocarbon components;

(8) said vapor stream is compressed to higher pressure and thereafter supplied to said contacting device at a lower column feed point; and (9) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

4. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated sufficiently to vaporize at least a portion of it, supplying thereby at least a portion of said cooling of said distillation stream;

(5) said heated liquefied natural gas stream is directed into said contacting device, wherein said distillation stream and a liquid stream are formed and separated;

(6) said liquid stream is directed into a fractionation column operating at a pressure lower than the pressure of said contacting device wherein said stream is further fractionated by separating it into a vapor stream and said relatively less volatile fraction containing a major portion of said heavier hydrocarbon components;

(7) said vapor stream is cooled to substantial condensation;

(8) said substantially condensed stream is pumped to higher pressure, heated sufficiently to vaporize at least a portion of it, and thereafter supplied to said contacting device at a lower column feed point; and (9) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

5. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated to supply at least a portion of said cooling of said distillation stream and thereafter divided into at least a first stream and a second stream;

(5) said first stream is supplied to said contacting device at a mid-colunm feed position;

(6) said second stream is heated sufficiently to vaporize at least a portion of it and thereafter supplied to said contacting device at a lower column feed point, wherein said distillation stream and a liquid stream are formed and separated;

(7) said liquid stream is directed into a fractionation column operating at a pressure lower than the pressure of said contacting device wherein said stream is further fractionated by separating it into a vapor stream and said relatively less volatile fraction containing a major portion of said heavier hydrocarbon components;

(8) said vapor stream is cooled to substantial condensation;

(9) said substantially condensed stream is pumped to higher pressure, heated sufficiently to vaporize at least a portion of it, and thereafter supplied to said contacting device at a lower column feed point; and

(10) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

6. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated sufficiently to vaporize at least a portion of it, supplying thereby at least a portion of said cooling of said distillation stream;

(5) said heated liquefied natural gas stream is directed into said contacting device, wherein said distillation stream and a first liquid stream are formed and separated;

(6) said first liquid stream is directed into a fractionation column operating at a pressure lower than the pressure of said contacting device wherein said stream is further fractionated by separating it into a first vapor stream and said relatively less volatile fraction containing a major portion of said heavier hydrocarbon components;

(7) said first vapor stream is cooled sufficiently to partially condense it and is thereafter separated to form a second vapor stream and a second liquid stream;

(8) said second vapor stream is compressed to higher pressure and thereafter supplied to said contacting device at a lower column feed point;

(9) said second liquid stream is pumped to higher pressure, heated sufficiently to vaporize at least a portion of it, and thereafter supplied to said contacting device at a lower column feed point; and

(10) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

7. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated to supply at least a portion of said cooling of said distillation stream and thereafter divided into at least a first stream and a second stream;

(5) said first stream is supplied to said contacting device at a mid-column feed position;

(6) said second stream is heated sufficiently to vaporize at least a portion of it and thereafter supplied to said contacting device at a lower column feed point, wherein said distillation stream and a first liquid stream are formed and separated;

(7) said first liquid stream is directed into a fractionation column operating at a pressure lower than the pressure of said contacting device wherein said stream is further fractionated by separating it into a first vapor stream and said relatively less volatile fraction containing a major portion of said heavier hydrocarbon components;

(8) said first vapor stream is cooled sufficiently to partially condense it and is thereafter separated to form a second vapor stream and a second liquid stream;

(9) said second vapor stream is compressed to higher pressure and thereafter supplied to said contacting device at a lower column feed point;

(10) said second liquid stream is pumped to higher pressure, heated sufficiently to vaporize at least a portion of it, and thereafter supplied to said contacting device at a lower column feed point; and

(11) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

8. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated sufficiently to vaporize at least a portion of it, supplying thereby at least a portion of said cooling of said distillation stream;

(5) said heated liquefied natural gas stream is directed into said contacting device, wherein said distillation stream and a first liquid stream are formed and separated;

(6) said first liquid stream is directed into a fractionation column operating at a pressure lower than the pressure of said contacting device wherein said stream is further fractionated by separating it into a first vapor stream and said relatively less volatile fraction containing a major portion of said heavier hydrocarbon components;

(7) said first vapor stream is cooled sufficiently to partially condense it and is thereafter separated to form a second vapor stream and a second liquid stream;

(8) said second vapor stream is compressed to higher pressure;

(9) said second liquid stream is pumped to higher pressure and heated sufficiently to vaporize at least a portion of it;

(10) said compressed second vapor stream and said heated pumped second liquid stream are combined to form a combined stream and said combined stream is thereafter supplied to said contacting device at a lower column feed point; and

(11) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

9. In a process for the separation of liquefied natural gas containing methane and heavier hydrocarbon components, in which process said liquefied natural gas is fractionated into a more volatile fraction containing a major portion of said methane and a relatively less volatile fraction containing a major portion of said heavier hydrocarbon components;

the improvement wherein (1) a contacting device is provided to fractionate said liquefied natural gas;

(2) a distillation stream is withdrawn from an upper region of said contacting device, cooled sufficiently to partially condense it, and thereafter separated to form said more volatile fraction containing a major portion of said methane and a reflux stream;

(3) said reflux stream is supplied to said contacting device at a top column feed position;

(4) said liquefied natural gas stream is heated to supply at least a portion of said cooling of said distillation stream and thereafter divided into at least a first stream and a second stream;

(5) said first stream is supplied to said contacting device at a mid-column feed position;

(6) said second stream is heated sufficiently to vaporize at least a portion of it and thereafter supplied to said contacting device at a lower column feed point, wherein said distillation stream and a first liquid stream are formed and separated;

(7) said first liquid stream is directed into a fractionation column operating at a pressure lower than the pressure of said contacting device wherein said stream is further fractionated by separating it into a first vapor stream and said relatively less volatile fraction containing a major portion of said heavier hydrocarbon components;

(8) said first vapor stream is cooled sufficiently to partially condense it and is thereafter separated to form a second vapor stream and a second liquid stream;

(9) said second vapor stream is compressed to higher pressure;

(10) said second liquid stream is pumped to higher pressure and heated sufficiently to vaporize at least a portion of it;

(11) said compressed second vapor stream and said heated pumped second liquid stream are combined to form a combined stream and said combined stream is thereafter supplied to said contacting device at a lower column feed point; and

(12) the quantity and temperature of said reflux stream and the temperatures of said feeds to said contacting device and said fractionation column are effective to maintain the overhead temperatures of said contacting device and said fractionation column at temperatures whereby the major portion of said heavier hydrocarbon components is recovered in said relatively less volatile fraction.

10. The improvement according to claim 2 wherein said compressed vapor stream is cooled and thereafter supplied to said contacting device at a lower column feed point.

11. The improvement according to claim 3 wherein said compressed vapor stream is cooled and thereafter supplied to said contacting device at a lower column feed point.

12. The improvement according to claim 6 wherein said compressed second vapor stream is cooled and thereafter supplied to said contacting device at a lower column feed point.

13. The improvement according to claim 7 wherein said compressed second vapor stream is cooled and thereafter supplied to said contacting device at a lower column feed point.

14. The improvement according to claim 8 wherein said compressed second vapor stream is cooled and thereafter combined with said heated pumped second liquid stream to form said combined stream.

15. The improvement according to claim 9 wherein said compressed second vapor stream is cooled and thereafter combined with said heated pumped second liquid stream to form said combined stream.

16. The improvement according to claim 2 wherein said vapor stream is heated, compressed to higher pressure, cooled, and thereafter supplied to said contacting device at a lower column feed point.

17. The improvement according to claim 3 wherein said vapor stream is heated, compressed to higher pressure, cooled, and thereafter supplied to said contacting device at a lower column feed point.

18. The improvement according to claim 6 wherein said second vapor stream is heated, compressed to higher pressure, cooled, and thereafter supplied to said contacting device at a lower column feed point.

19. The improvement according to claim 7 wherein said second vapor stream is heated, compressed to higher pressure, cooled, and thereafter supplied to said contacting device at a lower column feed point.

20. The improvement according to claim 8 wherein said second vapor stream is heated, compressed to higher pressure, cooled, and thereafter combined with said heated pumped second liquid stream to form said combined stream.

21. The improvement according to claim 9 wherein said second vapor stream is heated, compressed to higher pressure, cooled, and thereafter combined with said heated pumped second liquid stream to form said combined stream.

22. The improvement according to claim 1 wherein said distillation stream is cooled sufficiently to partially condense it in a dephlegmator and concurrently separated to form said more volatile fraction containing a major portion of said methane and said reflux stream, whereupon said reflux stream flows from the dephlegmator to the top fractionation stage of said fractionation column.

23. The improvement according to claim 2, 3, 4, 5, 6, 7, 8, 9, 10, 11, 12, 13, 14, 15, 16, 17, 18, 19, 20, or 21 wherein said distillation stream is cooled sufficiently to partially condense it in a dephlegmator and concurrently separated to form said more volatile fraction containing a major portion of said methane and said reflux stream, whereupon said reflux stream flows from the dephlegmator to the top fractionation stage of said contacting device.

24. In an apparatus for the separation of liquefied natural gas containing methane and heavier hydrocarbon components, in said apparatus there being (a) supply means to supply said liquefied natural gas to a fractionation column in one or more feed streams; and (b) a fractionation column connected to said supply means to receive said liquefied natural gas and fractionate it into a more volatile fraction containing a major portion of said methane and a relatively less volatile fraction containing a major portion of said heavier hydrocarbon components;

the improvement wherein said apparatus includes (1) withdrawing means connected to an upper region of said fractionation column to withdraw a distillation stream;

(2) first heat exchange means connected to said withdrawing means to receive said distillation stream and cool it sufficiently to partially condense it;

(3) separation means connected to said first heat exchange means to receive said partially condensed distillation stream and separate it into said more volatile fraction containing a major portion of said methane and a reflux stream, said separation means being further connected to said fractionation column to supply said reflux stream to said fractionation column at a top column feed position;

(4) first heat exchange means further connected to said supply means to receive said liquefied natural gas and heat it, thereby supplying at least a portion of said cooling of said distillation stream;

(5) dividing means connected to said first heat exchange means to receive said heated liquefied natural gas and divide it into at least a first stream and a second stream, said dividing means being further connected to said fractionation column to supply said first stream at an upper mid-column feed position;

(6) second heat exchange means connected to said dividing means to receive said second stream and heat it sufficiently to vaporize at least a portion of it, said second heat exchange means being further connected to said fractionation column to supply said heated second stream at a lower mid-column feed position; and (7) control means adapted to regulate the quantity and temperature of said reflux stream and the temperatures of said feed streams to said fractionation column to maintain the overhead temperature of said fractionation column at a temperature whereby the major portion of said heavier hydrocarbon components is recovered in said relatively less volatile fraction.

25. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) separation means connected to said first heat exchange means to receive said partially condensed distillation stream and separate it into a more volatile fraction containing a major portion of said methane and a reflux stream, said separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) second heat exchange means connected to said first heat exchange means to receive said heated liquefied natural gas and further heat it sufficiently to vaporize at least a portion of it;

(7) said contacting and separating means connected to receive said further heated liquefied natural gas, whereupon said distillation stream and a liquid stream are formed and separated;

(8) a fractionation column operating at a pressure lower than the pressure of said contacting and separating means, said fractionation column being connected to receive said liquid stream and separate it into a vapor stream and a relatively less volatile fraction containing a major portion of said heavier hydrocarbon components;

(9) compressing means connected to said fractionation column to receive said vapor stream and compress it to higher pressure, said compressing means being further connected to said contacting and separating means to supply said compressed vapor stream at a lower column feed point; and

(10) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

26. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) separation means connected to said first heat exchange means to receive said partially condensed distillation stream and separate it into a more volatile fraction containing a major portion of said methane and a reflux stream, said separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) dividing means connected to said first heat exchange means to receive said heated liquefied natural gas and divide it into at least a first stream and a second stream;

(7) second heat exchange means connected to said dividing means to receive said second stream and heat it sufficiently to vaporize at least a portion of it;

(8) said contacting and separating means connected to receive said first stream at a mid-column feed position and said heated second stream at a lower column feed point, whereupon said distillation stream and a liquid stream are formed and separated;

(9) a fractionation column operating at a pressure lower than the pressure of said contacting and separating means, said fractionation column being connected to receive said liquid stream and separate it into a vapor stream and a relatively less volatile fraction containing a major portion of said heavier hydrocarbon components;

(10) compressing means connected to said fractionation column to receive said vapor stream and compress it to higher pressure, said compressing means being further connected to said contacting and separating means to supply said compressed vapor stream at a lower column feed point; and

(11) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

27. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) separation means connected to said first heat exchange means to receive said partially condensed distillation stream and separate it into a said more volatile fraction containing a major portion of said methane and a reflux stream, said separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) second heat exchange means connected to receive said heated liquefied natural gas and further heat it sufficiently to vaporize at least a portion of it;

(7) said contacting and separating means connected to receive said further heated liquefied natural gas, whereupon said distillation stream and a liquid stream are formed and separated;

(8) a fractionation column operating at a pressure lower than the pressure of said contacting and separating means, said fractionation column being connected to receive said liquid stream and separate it into a vapor stream and a relatively less volatile fraction containing a major portion of said heavier hydrocarbon components;

(9) second heat exchange means further connected to said fractionation column to receive said vapor stream and cool it to substantial condensation;

(10) pumping means connected to said second heat exchange means to receive said substantially condensed stream and pump it to higher pressure;

(11) said second heat exchange means further connected to said pumping means to receive said pumped substantially condensed stream and vaporize at least a portion of it, thereby supplying at least a portion of said cooling of said vapor stream, said second heat exchange means being further connected to said contacting and separating means to supply said at least partially vaporized pumped stream to said contacting and separating means at a lower column feed point; and

(12) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

28. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) separation means connected to said first heat exchange means to receive said partially condensed distillation stream and separate it into a more volatile fraction containing a major portion of said methane and a reflux stream, said separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) second heat exchange means connected to said first heat exchange means to receive said heated liquefied natural gas and further heat it;

(7) dividing means connected to said second heat exchange means to receive said further heated liquefied natural gas and divide it into at least a first stream and a second stream;

(8) third heat exchange means connected to said dividing means to receive said second stream and heat it sufficiently to vaporize at least a portion of it;

(9) said contacting and separating means connected to receive said first stream at a mid-column feed position and said heated second stream at a lower column feed point, whereupon said distillation stream and a liquid stream are formed and separated;

(10) a fractionation column operating at a pressure lower than the pressure of said contacting and separating means, said fractionation column being connected to receive said liquid stream and separate it into a vapor stream and a relatively less volatile fraction containing a major portion of said heavier hydrocarbon components;

(11) second heat exchange means further connected to said fractionation column to receive said vapor stream and cool it to substantial condensation;

(12) pumping means connected to said second heat exchange means to receive said substantially condensed stream and pump it to higher pressure;

(13) said second heat exchange means further connected to said pumping means to receive said pumped substantially condensed stream and vaporize at least a portion of it, thereby supplying at least a portion of said cooling of said vapor stream, said second heat exchange means being further connected to said contacting and separating means to supply said at least partially vaporized pumped stream to said contacting and separating means at a lower column feed point; and

(14) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

29. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) first separation means connected to said first heat exchange means to receive said partially condensed distillation stream and separate it into a more volatile fraction containing a major portion of said methane and a reflux stream, said first separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) second heat exchange means connected to receive said heated liquefied natural gas and further heat it sufficiently to vaporize at least a portion of it;

(7) said contacting and separating means connected to receive said further heated liquefied natural gas, whereupon said distillation stream and a first liquid stream are formed and separated;

(8) a fractionation column operating at a pressure lower than the pressure of said contacting and separating means, said fractionation column being connected to receive said first liquid stream and separate it into a first vapor stream and a relatively less volatile fraction containing a major portion of said heavier hydrocarbon components;

(9) second heat exchange means further connected to said fractionation column to receive said first vapor stream and cool it sufficiently to partially condense it;

(10) second separation means connected to receive said partially condensed first vapor stream and separate it into a second vapor stream and a second liquid stream;

(11) compressing means connected to said second separation means to receive said second vapor stream and compress it to higher pressure, said compressing means being further connected to said contacting and separating means to supply said compressed second vapor stream at a lower column feed point;

(12) pumping means connected to said second separation means to receive said second liquid stream and pump it to higher pressure;

(13) said second heat exchange means further connected to said pumping means to receive said pumped second liquid stream and vaporize at least a portion of it, thereby supplying at least a portion of said cooling of said first vapor stream, said second heat exchange means being further connected to said contacting and separating means to supply said at least partially vaporized pumped stream to said contacting and separating means at a lower column feed point; and

(14) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

30. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) first separation means connected to said first heat exchange means to receive said partially condensed distillation stream and separate it into a more volatile fraction containing a major portion of said methane and a reflux stream, said first separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) second heat exchange means connected to said first heat exchange means to receive said heated liquefied natural gas and further heat it;

(7) dividing means connected to said second heat exchange means to receive said further heated liquefied natural gas and divide it into at least a first stream and a second stream;

(8) third heat exchange means connected to said dividing means to receive said second stream and heat it sufficiently to vaporize at least a portion of it;

(9) said contacting and separating means connected to receive said first stream at a mid-column feed position and said heated second stream at a lower column feed point, whereupon said distillation stream and a first liquid stream are formed and separated;

(10) a fractionation column operating at a pressure lower than the pressure of said contacting and separating means, said fractionation column being connected to receive said first liquid stream and separate it into a first vapor stream and a relatively less volatile fraction containing a major portion of said heavier hydrocarbon components;

(11) second heat exchange means further connected to said fractionation column to receive said first vapor stream and cool it sufficiently to partially condense it;

(12) second separation means connected to receive said partially condensed first vapor stream and separate it into a second vapor stream and a second liquid stream;

(13) compressing means connected to said second separation means to receive said second vapor stream and compress it to higher pressure, said compressing means being further connected to said contacting and separating means to supply said compressed second vapor stream at a lower column feed point;

(14) pumping means connected to said second separation means to receive said second liquid stream and pump it to higher pressure;

(15) said second heat exchange means further connected to said pumping means to receive said pumped second liquid stream and vaporize at least a portion of it, thereby supplying at least a portion of said cooling of said first vapor stream, said second heat exchange means being further connected to said contacting and separating means to supply said at least partially vaporized pumped stream to said contacting and separating means at a lower column feed point; and

(16) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

31. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) first separation means connected to said first heat exchange means to receive said partially condensed distillation stream and separate it into a more volatile fraction containing a major portion of said methane and a reflux stream, said first separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) second heat exchange means connected to receive said heated liquefied natural gas and further heat it sufficiently to vaporize at least a portion of it;

(7) said contacting and separating means connected to receive said further heated liquefied natural gas, whereupon said distillation stream and a first liquid stream are formed and separated;

(8) a fractionation column operating at a pressure lower than the pressure of said contacting and separating means, said fractionation column being connected to receive said first liquid stream and separate it into a first vapor stream and a relatively less volatile fraction containing a major portion of said heavier hydrocarbon components;

(9) second heat exchange means further connected to said fractionation column to receive said first vapor stream and cool it sufficiently to partially condense it;

(10) second separation means connected to receive said partially condensed first vapor stream and separate it into a second vapor stream and a second liquid stream;

(11) compressing means connected to said second separation means to receive said second vapor stream and compress it to higher pressure;

(12) pumping means connected to said second separation means to receive said second liquid stream and pump it to higher pressure;

(13) said second heat exchange means further connected to said pumping means to receive said pumped second liquid stream and vaporize at least a portion of it, thereby supplying at least a portion of said cooling of said first vapor stream;

(14) combining means connected to said compressing means and said second heat exchange means to receive said compressed second vapor stream and at least partially vaporized pumped stream and form thereby a combined stream, said combining means being further connected to said contacting and separating means to supply said combined stream to said contacting and separating means at a lower column feed point; and

(15) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

32. An apparatus for the separation of liquefied natural gas containing methane and heavier hydrocarbon components comprising (1) supply means to supply said liquefied natural gas to contacting and separating means, said contacting and separating means including separating means to separate resultant vapors and liquids after contact;

(2) withdrawing means connected to an upper region of said contacting and separating means to withdraw a distillation stream;

(3) first heat exchange means connected to said withdrawing means to receive said distillation stream and cool it sufficiently to partially condense it;

(4) first separation means connected to said first heat exchange means to receive said partially condensed distillation stream and separate it into a more volatile fraction containing a major portion of said methane and a reflux stream, said first separation means being further connected to said contacting and separating means to supply said reflux stream to said contacting and separating means at a top column feed position;

(5) first heat exchange means further connected to said supply means to receive said liquefied natural gas and heat it, thereby supplying at least a portion of said cooling of said distillation stream;

(6) second heat exchange means connected to said first heat exchange means to receive said heated liquefied natural gas and further heat it;

(7) dividing means connected to said second heat exchange means to receive said further heated liquefied natural gas and divide it into at least a first stream and a second stream;

(8) third heat exchange means connected to said dividing means to receive said second stream and to heat it sufficiently to vaporize at least a portion of it;

(9) said contacting and separating means connected to receive said first stream at a mid-column feed position and said heated second stream at a lower column feed point, whereupon said distillation stream and a first liquid stream are formed and separated;

(10) a fractionation column operating at a pressure lower than the pressure of said contacting and separating means, said fractionation column being connected to receive said first liquid stream and separate it into a first vapor stream and a relatively less volatile fraction containing a major portion of said heavier hydrocarbon components;

(11) second heat exchange means further connected to said fractionation column to receive said first vapor stream and cool it sufficiently to partially condense it;

(12) second separation means connected to receive said partially condensed first vapor stream and separate it into a second vapor stream and a second liquid stream;

(13) compressing means connected to said second separation means to receive said second vapor stream and compress it to higher pressure;

(14) pumping means connected to said second separation means to receive said second liquid stream and pump it to higher pressure;

(15) said second heat exchange means further connected to said pumping means to receive said pumped second liquid stream and vaporize at least a portion of it, thereby supplying at least a portion of said cooling of said first vapor stream;

(16) combining means connected to said compressing means and said second heat exchange means to receive said compressed second vapor stream and at least partially vaporized pumped stream and form thereby a combined stream, said combining means being further connected to said contacting and separating means to supply said combined stream to said contacting and separating means at a lower column feed point; and

(17) control means adapted to regulate the quantity and temperature of said reflux stream and the temperatures of said feed streams to said contacting and separating means and said fractionation column to maintain the overhead temperatures of said contacting and separating means and said fractionation column at temperatures whereby the major portion of said heavier hydrocarbon components is recovered in said relatively less volatile fraction.

33. The improvement according to claim 25 wherein a cooling means is connected to said compressing means to receive said compressed vapor stream and cool it, said cooling means being further connected to said contacting and separating means to supply said cooled compressed vapor stream to said contacting and separating means at a lower column feed point.

34. The improvement according to claim 26 wherein a cooling means is connected to said compressing means to receive said compressed vapor stream and cool it, said cooling means being further connected to said contacting and separating means to supply said cooled compressed vapor stream to said contacting and separating means at a lower column feed point.

35. The improvement according to claim 29 wherein a cooling means is connected to said compressing means to receive said compressed second vapor stream and cool it, said cooling means being further connected to said contacting and separating means to supply said cooled compressed second vapor stream to said contacting and separating means at a lower column feed point.

36. The improvement according to claim 30 wherein a cooling means is connected to said compressing means to receive said compressed second vapor stream and cool it, said cooling means being further connected to said contacting and separating means to supply said cooled compressed second vapor stream to said contacting and separating means at a lower column feed point.

37. The improvement according to claim 31 wherein a cooling means is connected to said compressing means to receive said compressed second vapor stream and cool it, said cooling means being further connected to said combining means to supply said cooled compressed second vapor stream to said combining means and form thereby said combined stream.

38. The improvement according to claim 32 wherein a cooling means is connected to said compressing means to receive said compressed second vapor stream and cool it, said cooling means being further connected to said combining means to supply said cooled compressed second vapor stream to said combining means and form thereby said combined stream.

39. The improvement according to claim 25 wherein a heating means is connected to said fractionation column to receive said vapor stream and heat it, said compressing means is connected to said heating means to receive said heated vapor stream and compress it to higher pressure, and a cooling means is connected to said compressing means to receive said compressed heated vapor stream and cool it, said cooling means being further connected to said contacting and separating means to supply said cooled compressed vapor stream to said contacting and separating means at a lower column feed point.

40. The improvement according to claim 26 wherein a heating means is connected to said fractionation column to receive said vapor stream and heat it, said compressing means is connected to said heating means to receive said heated vapor stream and compress it to higher pressure, and a cooling means is connected to said compressing means to receive said compressed heated vapor stream and cool it, said cooling means being further connected to said contacting and separating means to supply said cooled compressed vapor stream to said contacting and separating means at a lower column feed point.

41. The improvement according to claim 29 wherein a heating means is connected to said second separation means to receive said second vapor stream and heat it, said compressing means is connected to said heating means to receive said heated second vapor stream and compress it to higher pressure, and a cooling means is connected to said compressing means to receive said compressed heated second vapor stream and cool it, said cooling means being further connected to said contacting and separating means to supply said cooled compressed second vapor stream to said contacting and separating means at a lower column feed point.

42. The improvement according to claim 30 wherein a heating means is connected to said second separation means to receive said second vapor stream and heat it, said compressing means is connected to said heating means to receive said heated second vapor stream and compress it to higher pressure, and a cooling means is connected to said compressing means to receive said compressed heated second vapor stream and cool it, said cooling means being further connected to said contacting and separating means to supply said cooled compressed second vapor stream to said contacting and separating means at a lower column feed point.

43. The improvement according to claim 31 wherein a heating means is connected to said second separation means to receive said second vapor stream and heat it, said compressing means is connected to said heating means to receive said heated second vapor stream and compress it to higher pressure, and a cooling means is connected to said compressing means to receive said compressed heated second vapor stream and cool it, said cooling means being further connected to said combining means to supply said cooled compressed second vapor stream to said combining means and form thereby said combined stream.

44. The improvement according to claim 32 wherein a heating means is connected to said second separation means to receive said second vapor stream and heat it, said compressing means is connected to said heating means to receive said heated second vapor stream and compress it to higher pressure, and a cooling means is connected to said compressing means to receive said compressed heated second vapor stream and cool it, said cooling means being further connected to said combining means to supply said cooled compressed second vapor stream to said combining means and form thereby said combined stream.

45. The improvement according to claim 24 wherein (1) a dephlegmator is connected to said supply means to receive said liquefied natural gas and provide for the heating of said liquefied natural gas, said dephlegmator being further connected to said fractionation column to receive said distillation stream and cool it sufficiently to partially condense it and concurrently separate it to form said volatile residue gas fraction and said reflux stream, said dephlegmator being further connected to said fractionation column to supply said reflux stream as a top feed thereto; and (2) said dividing means is connected to said dephlegmator to receive said heated liquefied natural gas.

46. The improvement according to claim 25, 27, 28, 29, 30, 31, 32, 33, 34, 35, 36, 37, 38, 39, 40, 41, 42, 43, or 44 wherein (1) a dephlegmator is connected to said supply means to receive said liquefied natural gas and provide for the heating of said liquefied natural gas, said dephlegmator being further connected to said contacting and separating means to receive said distillation stream and cool it sufficiently to partially condense it and concurrently separate it to form said volatile residue gas fraction and said reflux stream, said dephlegmator being further connected to said contacting and separating means to supply said reflux stream as a top feed thereto; and (2) said second heat exchange means is connected to said dephlegmator to receive said heated liquefied natural gas.

47. The improvement according to claim 26 wherein (1) a dephlegmator is connected to said supply means to receive said liquefied natural gas and provide for the heating of said liquefied natural gas, said dephlegmator being further connected to said contacting and separating means to receive said distillation stream and residue gas fraction and said reflux stream, said dephlegmator being further connected to said contacting and separating means to supply said reflux stream as a top feed thereto; and (2) said dividing means is connected to said dephlegmator to receive said heated liquefied natural gas.

* * * * *